US006312319B1

(12) United States Patent
Donohue et al.

(10) Patent No.: US 6,312,319 B1
(45) Date of Patent: Nov. 6, 2001

(54) POLISHING MEDIA MAGAZINE FOR IMPROVED POLISHING

(76) Inventors: Timothy J. Donohue, 542 Forest Ave., Palo Alto, CA (US) 94301; Roger O. Williams, 4678 E. Foothill Dr., Paradise Valley, AZ (US) 85253; John A. Barber, 14455 Black Walnut Ct., Saratoga, CA (US) 95070; Jon A. Hoshizaki, 6708 John Dr., Cupertino, CA (US) 95014; Lawrence Lee, 346 Carroll St., Sunnyvale, CA (US) 94086; Ching-Ling Meng, 3634 Fitzsimmons Common, Fremont, CA (US) 94538; Phil R. Sommer, 7811 Hazelnut Dr., Newark, CA (US) 94560

( * ) Notice: Subject to any disclaimer, the term of this patent is extended or adjusted under 35 U.S.C. 154(b) by 0 days.

(21) Appl. No.: 09/402,596

(22) PCT Filed: Apr. 6, 1998

(86) PCT No.: PCT/US98/06844

§ 371 Date: Apr. 10, 2000

§ 102(e) Date: Apr. 10, 2000

(87) PCT Pub. No.: WO98/45090

PCT Pub. Date: Oct. 15, 1998

Related U.S. Application Data

(63) Continuation-in-part of application No. 08/833,278, filed on Apr. 4, 1997, now abandoned.

(51) Int. Cl.[7] ..... B24B 1/00; B24B 7/00; B24B 21/00

(52) U.S. Cl. ..... 451/56; 451/36; 451/57; 451/59; 451/65; 451/72; 451/168; 451/288; 451/305; 451/306; 451/307; 451/443; 451/495; 451/493; 451/530

(58) Field of Search ..... 451/36, 37, 41, 451/56, 57, 59, 65, 72, 168, 285, 287, 288, 290, 305, 306, 307, 443, 444, 491, 493, 495, 526, 530

(56) References Cited

U.S. PATENT DOCUMENTS

| | | | | |
|---|---|---|---|---|
| 4,356,671 | * | 11/1982 | Gabrielson et al. . | |
| 5,335,453 | | 8/1994 | Baldy et al. . | |
| 5,484,323 | | 1/1996 | Smith | 451/10 |
| 5,516,400 | | 5/1996 | Pasch et al. | 451/56 X |
| 5,941,762 | | 8/1999 | Ravkin et al. | 451/56 |
| 5,961,372 | | 10/1999 | Shendon | 451/41 |
| 6,139,404 | * | 10/2000 | Yau | 451/56 |

FOREIGN PATENT DOCUMENTS

| | | |
|---|---|---|
| 0 517 594 | 12/1992 | (EP) . |
| 0 696 495 | 2/1996 | (EP) . |
| 93 02837 | 2/1993 | (WO) . |

* cited by examiner

*Primary Examiner*—Timothy V. Eley
(74) *Attorney, Agent, or Firm*—Thomason, Moser & Patterson

(57) ABSTRACT

A polishing media magazine for improved polishing. The polishing media magazine may include a conditioning element for rapid, uniform conditioning and cleaning of the polishing media. The polishing media magazine may include polishing media having sections of raised elevation to contain the fluid and may include a polishing support platen having features adapted to urge the edges of the polishing media upwards. The polishing media may be roll fed from a supply roll across a support platen and onto a take-up roll.

45 Claims, 27 Drawing Sheets

POLISHING MEDIA MAGAZINE FOR IMPROVED POLISHING

This application is a 371 of PCT/US98/06844 filed Apr. 6, 1998, which is a CIP of Ser. No. 08/833,278 filed Apr. 4, 1997, now abandoned.

FIELD OF THE INVENTION

This invention generally relates to the field of semiconductor processing equipment and particularly to a polishing apparatus. More specifically this invention relates to a polishing media magazine for improved polishing.

BACKGROUND OF THE INVENTION

Polishing a workpiece to produce a mirror-like, defect-free surface has applications in many fields of endeavor. Such polishing processes have become extremely important and widespread, for example, in the fabrication of semiconductor devices. The critical step of polishing a semiconductive wafer or substrate is required at a number of different stages along the varied processes employed to fabricate semiconductor devices.

The manufacture of integrated circuits generally involves an elaborate system of fabricating semiconductor devices on a wafer or substrate and connecting the devices together. The devices are connected by a process generally referred to as metalization, in which connecting lines of metal, often aluminum, are applied by vacuum deposition or other suitable processes.

The performance level of semiconductor devices employing a conventional single metal layer connecting the devices is fast becoming unsuitable. Modem, high performance devices utilize multilevel metal interconnections. Multilevel connections may be constructed by depositing a dielectric or insulating layer over a first metal layer, etching via holes throughout the dielectric layer, and then depositing a second metal layer which fill the via holes to connect with the first metal layer. These devices offer higher device density and shortened interconnection lengths between the devices.

Since each of these metal and dielectric layers have an appreciable thickness, the wafer substrate is left with a non-planar topography as the various layers are patterned on top of one another. This type of non-planarity is often unacceptable in high density devices because the depth of field of the lithographic equipment that is used to print the smaller line width circuits on the wafer does not have a depth of focus sufficient to compensate for even small variations in wafer planarity.

In addition to the non-planarity caused by the fabricated device patterns, in-process wafer polishing, or planarization, must account for variations in overall wafer flatness as well. During the fabrication process, for example, the wafers may become bowed or warped.

In process polishing equipment, therefore, requires the specialized ability to achieve global, uniformly planar wafer surfaces in spite of these topographical wafer defects and variations. Chemical-mechanical polishing has gained wide acceptance as an effective means of achieving the global wafer surface planarity required by advanced devices employing multilayer metalization.

FIG. 1 shows a partial cross section of a typical prior art chemical-mechanical polishing arrangement. A typical device includes a tooling head having a generally circular pressure plate or carrier platen 1 that supports a single substrate or wafer 3. A carrier film 2 may be interposed between the carrier platen 1 and the wafer 3 to partially accommodate wafer thickness variations. The tooling head is equipped with means to provide a downward force, urging the wafer 3 against a polishing media 5 (typically a circular pad), onto which is fed a polishing fluid 7. The polishing media is supported by the polishing platen 6. The polishing fluid 7 may comprise a colloidal suspension of an abrasive and may also comprise of a chemically reactive solution. A containment ring 4 generally surrounds the wafer to prevent it from slipping off the carrier platen 1 during polishing.

Typically, movement of the wafer relative to the pad, in the presence of the chemically reactive and/or abrasive polishing fluid and under pressure imparted by the tooling head, imparts a combination of chemical and mechanical forces to the wafer 3, the net effect of which is global planarization of the wafer surface. Generally, the polishing platen 6 is rotatable as is the carrier platen 1. In a typical polishing apparatus, relative movement of the wafer relative to the pad is accomplished by rotating the polishing platen 6, the carrier platen 1, or both.

Because the manufacturing plant required to produce semiconductor devices is very costly, it is important that each piece of semiconductor process equipment installed in the fabrication line make economical use of the time required for its particular process and the physical space required for use. For this reason, there is constant pressure to improve total process throughput and reduce the amount of floorspace required for semiconductor process equipment.

In this regard, polishing machines used in the semiconductor device fabrication process are not optimized. Current chemical-mechanical polishing machines do not have the ability to deliver substantially uninterrupted polishing media and have difficulty in uniformly conditioning the polishing media for continued use after a certain amount of polishing has been performed.

Rotating platen machines typically install a circular polishing pad and use it until the pad fails to obtain acceptable results because the pad becomes worn or becomes glazed with impacted polishing fluid and polishing particulate. At that time it is required to interrupt the polishing process and change the polishing pad.

Some polishing machines have employed a conditioning device, such as a spinning head, to condition the pad. The purpose of such conditioning is to create and revitalize the structure on the polishing media that retains the slurry dispersion for the polish process. Conditioning also serves to liberate and remove material impacted into the pad in the course of polish processing. Specific applications of conditioning may serve to planarize the polishing pad as well as cut or form a desired pattern into the polishing surface. Such a pattern is useful, for example, to facilitate uniform slurry distribution over the pad.

In current machines, conditioning is generally performed in the same planar area as the processing area. Typically, when the platen is rotating, a smaller spinning head is moved across the radius of the platen. Because of the inherent surface velocity differentials associated with the spinning head and the rotating platen, it is very difficult to ensure that a constant relative velocity between the rotating platen and the spinning head was accomplished at every point during conditioning. Such a constant relative velocity is required to ensure equal and uniform conditioning.

In addition, conditioning defects are often created as a result of misalignment of the surface of the spinning head to the plane of the polishing media. Even when suitably aligned, once polishing begins the spinning head is subject to substantial and varying friction forces at the conditioning surface. These forces tend to adversely affect the alignment of the head causing an edge of the spinning head to dig into the pad. The inability to provide uniform, defect free conditioning of the polishing pad surface inevitably causes a corresponding degradation in the polish processing results. Furthermore, while these types of conditioning may extend the polishing pad life somewhat, it is still required to install a new pad at a higher than desired frequency.

Another source of concern for the creation of wafer defects as a result of the conditioning is in the advent of conditioning particle(s), or conditioning elements becoming liberated from the conditioning device used, wherein the liberated conditioning elements (i.e. diamond chip) can become imbedded in the polishing media. The imbedded conditioning elements are a primary source of scratch defects found in wafers in the course of process polishing. Given the appearance of wafer scratch defects, the process requires immediate shutdown for replacement of the polishing pad media.

Another area that has not been optimized on current polishing machines is the control and maintenance of polishing fluids. Control and containment of the polishing fluid is important for many reasons. Typically, the polishing fluid is comprised to provide not only the abrasive particulate for mechanical polishing, but also to be chemically reactive with the wafer surface that is to be polished. It is important, therefore, that there exists on the polishing media an adequate amount of polishing fluid so that no areas of the wafer suffer any deficiency of polishing fluid as the wafer is moved relative to the polishing media. For example, if parts of the wafer were to suffer from a deficiency of polishing fluid, it would accordingly have a removal rate different from the areas of the wafer that were adequately supplied.

Another aspect of the importance of polishing fluid control is the desire to make the most efficient use of the polishing fluid. As mentioned above, polishing fluid applied to the polishing media generally spills or washes over the edge of the polishing platen at some point during the polishing process on current polishing machines. This polishing fluid is not readily reusable or recoverable and must be replaced by an adequate amount of new polishing fluid. It should be apparent that allowing the polishing fluid to exit the polishing media too quickly will result in an increased rate of polishing fluid usage over time thus lowering efficiency and increasing costs. Allowing the polishing fluid to have an increased resident time on the polishing media before exit, on the other hand, allows for full use of the polishing fluid before it becomes chemically unreactive or contaminated.

Still another aspect of the importance of polishing fluid control and containment is the need to maintain the polishing fluid in a clean, controlled space. Prior art devices employing a spinning platen and wafer carrier do not allow for adequate control of the polishing fluid as it exits the rotating polishing media. Polishing fluid is disadvantageously allowed to reach places where it can cause cleanliness problems, equipment reliability problems and, perhaps more importantly, polishing defects on the wafer itself.

The problems associated with allowing polishing fluid to reach places other that the front side of the polishing media is due to the fact that the polishing fluids used may dry to form a hard substance. These dried deposits are not only difficult to clean but may also disadvantageously flake off into unwanted places within the polishing environment. If the polishing fluid is allowed to reach the back side of the polishing media, it may form a raised deposit between the polishing platen and the polishing media resulting in polish defects in the wafer due to the increased removal rate in the vicinity of the raised deposit. Even when wet, the polishing fluids may tend to attack the pressure sensitive adhesives used in the construction of many of the composite polishing media, causing pad delamination and polishing failure.

Devices known in the art have not provided a complete solution to these slurry containment problems. For example, some polishing devices employ a vertical ring or dam structure around the periphery of a rotating polishing platen. U.S. Pat. Nos. 4,910,155 and 5,299,393 disclose the use of a separate dam structure designed to be placed around the circular periphery of the polishing table to prevent leakage of liquid polishing fluid from the polishing table. The dam allows a pool of polishing fluid to be formed to a depth of about one-quarter inch. With this arrangement, however, the polishing fluid periodically becomes contaminated and chemically unreactive requiring it to be washed off the polish table and replaced with a fresh batch of polishing fluid.

Other polishing devices provide for a more slanted ring feature around the periphery of the circular polishing table. U.S. Pat. No. 5,398,459 discloses a turntable ring positioned radially outwardly of the polishing media to help the abrasive polishing fluid from being scattered around during polishing. U.S. Pat. No. 5,384,986 discloses a similar structure designed to help prevent a protective fluid, such as water, from flowing radially off the pad to prevent the pad from drying out when not polishing. The slant and incline height of the surface is selected, however, to allow fluid on the polishing platen, or turntable, to be scattered quickly outward away from the polishing platen when the turntable is rotated during polishing.

Still another device, disclosed in U.S. Pat. No. 5,516,400, attempts to create a dam or fluid hillock by forming an integral annular lip on the front surface of a top layer of a composite pad. An upper polishing pad is mounted to a lower pad and is sized so that an extreme outer edge portion of the upper pad extends beyond the lower pad. This outer edge portion is bent downwardly so that the polishing fluid that spills over the hillock is less able to wick back up to the lower pad to attack the adhesive and cause delamination.

While these devices tend to create a polishing fluid pool which may help to ensure the availability of an adequate amount of polishing fluid at the point of polishing, none of the devices are able to fully contain the polishing fluid from reaching undesirable locations and at the same time allow for continuous feed of new polishing fluid material for uninterrupted, continuous polishing.

It would be desirable to have an apparatus with the capability to deliver a continuous supply of polishing media without need for frequent operator intervention. It would also be desirable to have an apparatus with the ability to condition such a polishing media supply as needed as well as adequately contain the fluids used during processing. Such an apparatus would advantageously provide improvements in economy, processing throughput, reliability and amount of required floorspace for operation.

SUMMARY OF THE INVENTION

This invention involves a polishing media magazine for improved polishing. According to one aspect of the present invention, the polishing media magazine may involve a conditioning element which provides rapid, uniform conditioning of the polishing media. The conditioning element may extend across the full width of the polishing media.

In one embodiment the conditioning element is in forced contact with the surface of the polishing media. When such forced contact is employed, an area of contact between the conditioning element and the polishing media may be formed.

A portion of the polishing media may be held in tension. The polishing media may be held in tension between turnbar elements, as for example with a continuous belt or roll-fed polishing media. In one embodiment, the polishing media magazine may have a polishing media supply roll, a take-up roll and a tensioned portion of polishing media extending there between. In one embodiment, the polishing media magazine may have a support platen positioned to support an area of the tensioned portion. This supported area, or process area, is typically used for polishing the workpiece.

In another aspect of the polishing media magazine, the tensioned portion is positionally indexable. This may allow a desired width element of polishing media from the supported area to be indexed to a conditioning element that is, in one embodiment, placed outside of the supported process area for conditioning.

The conditioning element may be a roller. The roller may have a certain surface geometry to effectuate a desired conditioning of the polishing media. In one aspect of the present invention the roller may be coated with abrasive particles such as diamond. The roller may also be formed of multiple shell elements.

A rotating brush may also be provided in conjunction with the conditioning roller or may operate alone to provide conditioning or cleaning. The rotating brush may comprise outwardly extending bristles. Additional cleaning may also be provided by the use of spray nozzles to wash or flush the polishing media or other conditioning elements.

The polishing media may be forced against the conditioning element by operation of the polishing media tension. Alternatively the polishing media may be forced against the conditioning element by way of a vacuum. According to one aspect of the present invention, a vacuum plenum may be positioned in proximity to the conditioning element such that the polishing media is uniformly biased against the conditioning element when vacuum is applied to the plenum.

In another embodiment, the polishing media is prepared for polishing using spray nozzles alone. In one aspect of the present invention, a suction channel may be used to remove excess fluid and other material as the polishing media is returned to the polishing position after conditioning.

In another embodiment, the conditioning element is a tensioned web or belt of conditioning media. The conditioning media may be supported by a support roller or rolling turnbar. The conditioning media may be coated with abrasive particles.

In another embodiment, the conditioning element is positioned within the process area. With this embodiment the conditioning element may be adapted to traverse over the polishing media. The conditioning element may be adapted to traverse the polishing media in any desired path. The conditioning element may be a roller or a generally flat bar. In one aspect the conditioning element is self-aligning to the polishing media that is to be polished.

In one aspect, the conditioning element is driven to traverse the process area by way of a drive mechanism. The drive mechanism may involve servo-driven lead screws to move the conditioning element in a first direction substantially perpendicular to the supply roll and a second direction substantially perpendicular to the first direction.

In yet another aspect, the polishing media magazine provides for a method of conditioning a polishing media involving the steps of applying tension to the polishing media such that a tensioned portion of polishing media is created having a width and an initial position; and indexing a portion of the tensioned portion in a forward direction to pass a rotating conditioning element at a predetermined velocity, the rotating conditioning element spanning substantially the entire width of the polishing media. The effective pressure between the polishing media to be conditioned and the conditioning element may be controlled by monitoring the tension applied to the polishing media. In another aspect of the present invention the effective pressure between the polishing media and the conditioning element is controlled by monitoring the vacuum level in a vacuum plenum adapted to bias the polishing media against the conditioning element.

In another aspect, the polishing media magazine provides for a method of conditioning a polishing media involving the steps of supporting the polishing media with a support platen, forcing a conditioning element to contact said polishing media across substantially the entire width of the polishing media, and directing said conditioning element to traverse the length of said polishing media according to a predetermined path.

In yet another aspect of the inventive polishing media magazine, the polishing media magazine is adapted to contain polishing fluid during polishing. According to one aspect of the invention, the apparatus may include a polishing media having sections of raised elevation to contain the polishing fluid or may include a polishing support platen having features adapted to urge the edges of the polishing media upwards.

The polishing media magazine may include polishing media having a center planar portion for polishing and a raised edge features for polishing fluid containment. The polishing media may also have a raised end section generally parallel to the raised end features. In the preferred construction the raised features are of sufficient height to prevent the polishing fluid from ever spilling over its uppermost raised edge.

The support platen features for urging the edges of the polishing media upwards may include a number of exemplary embodiments. The raised features may have contoured or radiused surfaces or may have relatively straight angled surfaces. Alternatively, rollers may be employed to urge the edges of the media upwards.

In another embodiment, rolling turnbars having enlarged or reduced diameter regions at its outer ends are employed to urge the media into the polishing fluid containment shape. Tension supplied to the polishing media from either or both of the supply roll or the take-up roll tend to keep the middle section of the media securely against the support platen and simultaneously force the edges of the media upwards for polishing fluid containment.

Another aspect of the present invention involves a conditioning module adapted for inline installation into a polishing machine. The conditioning module may have any suitable conditioning element and the appropriate rollers to establish the desired polishing media path around the conditioning element. In one aspect, the conditioning element is a roller or a brush and the rollers include an upper roller and a lower roller. In another aspect, the upper and lower rollers are driven to control the local tension of the polishing media through the conditioning module.

Another aspect of the inventive polishing media magazine involves a method of polishing involving the step of creating a mechanical stress in a polishing media during polishing wherein the mechanical properties of the polishing material are altered. In one aspect the stress is created by applying a uniform tension to the polishing media.

The invention described below solves the deficiencies of the prior art and offers a number of other features and advantages that will be apparent to one of ordinary skill in the art from the following detailed description, accompanying figures, and appended claims.

BEST MODE FOR CARRYING OUT THE INVENTION

Figure 1:
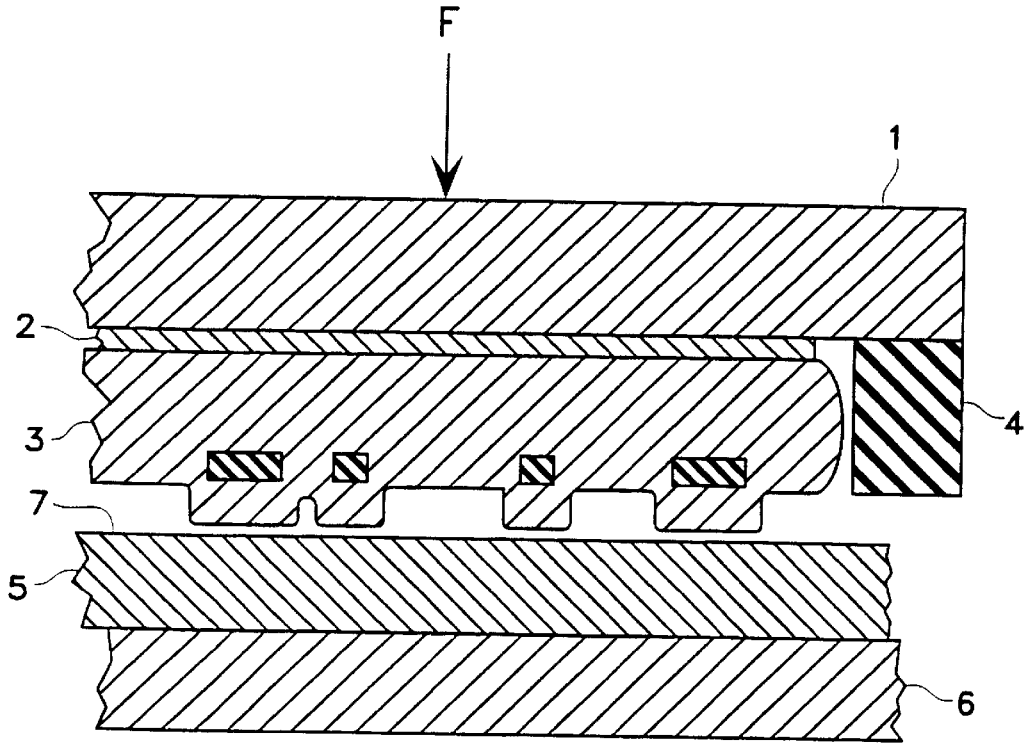
FIG. 1 (PRIOR ART)
FIG. 1 discussed above, is a cross-sectional view of the typical chemical mechanical polishing arrangement known in the art.

Referring to the drawings in detail wherein like numerals indicate like elements, the present invention generally involves a polishing media magazine. The polishing media magazine may be configured to provide a conditioned polishing surface. The polishing media magazine may involve a full width conditioning element constructed to ensure consistent and uniform conditioning at all points on the polishing media. The polishing media magazine may include a tensioned web of polishing media which may be supplied by a supply roll. The polishing media magazine may also generally include a slurry containment apparatus. The slurry containment apparatus may involve a platen assembly having raised sections.

Figure 2A:
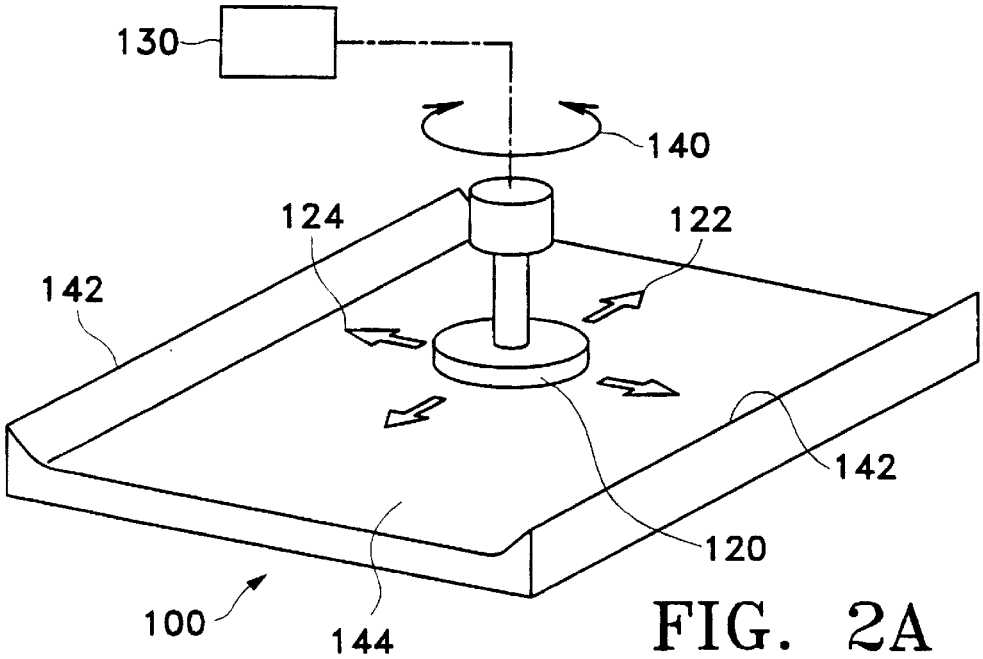
FIG. 2A is a perspective view showing one type of wafer polishing motion.
Figure 2B:
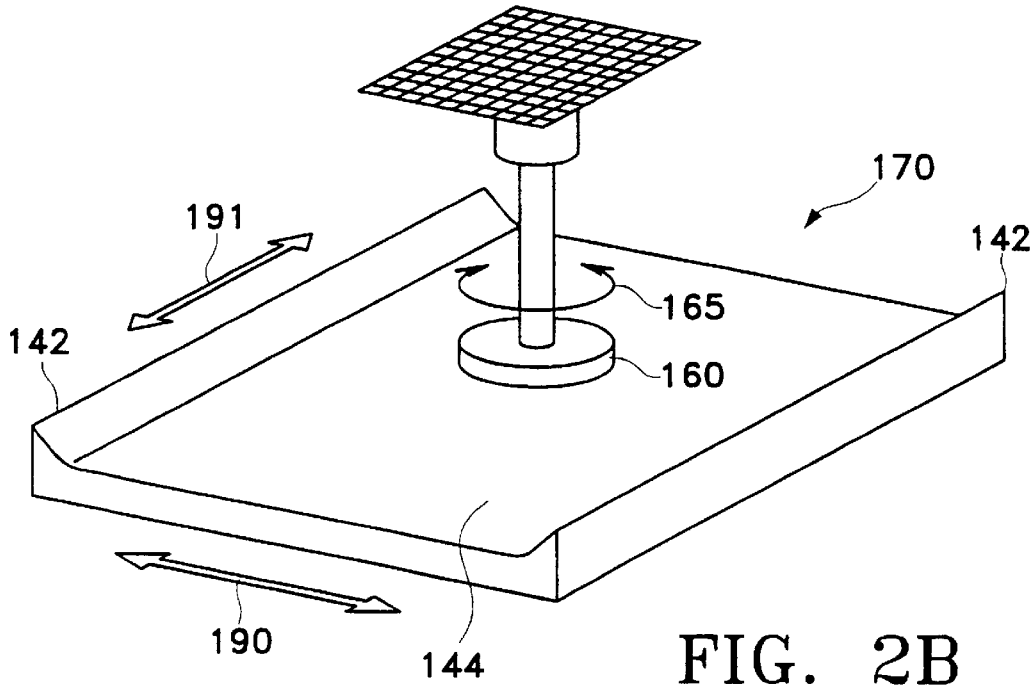
FIG. 2B is a perspective view showing an alternate type of wafer polishing motion.

To better understand the polishing media magazine invention outlined below, it is useful to understand the basic components of the polishing machine. Referring to FIGS. 2A and 2B, polishing head 120 is generally positioned over support platen 100 which typically supports a polishing pad or strip (not shown). Polishing head 120 is generally capable of supporting a wafer or substrate while supplying the required force to facilitate polishing. Polishing head 120 may have some ability to self align itself and the wafer to the plane of support platen 100.

FIG. 2A shows one type of arrangement to achieve the relative motion used to effectuate polishing. With this type of system, support platen 100 is non-movable and polishing head 120 provides all of the relative movement necessary for polishing. Polishing head 120, controlled by motion controller 130 is capable of controlled, or programmed, movement along the directions depicted by arrows 122 and 124 as well as rotation as depicted by arrow 140 if desired. Movement in each of the directions may be, and typically is, programmed to occur simultaneously.

FIG. 2B shows an alternate type of arrangement to achieve the desired relative motion for polishing. With this type of system, polishing head 160 is generally held in a fixed position except that it may be allowed or programmed to rotate as depicted by arrow 165. Full range of relative motion is achieved by moving the support platen 170 in the directions indicated by arrows 190 and 191, again typically under the direction of a motion controller (not shown).

Other variations to achieve the desired relative motion is possible, for example, the polishing head 160 could be allowed rotation depicted by arrow 165 and movement in a single direction, for example the direction indicated by arrow 191. At the same time, support platen 170 would be restricted to movement only in the direction indicated by arrow 190.

Figure 3:
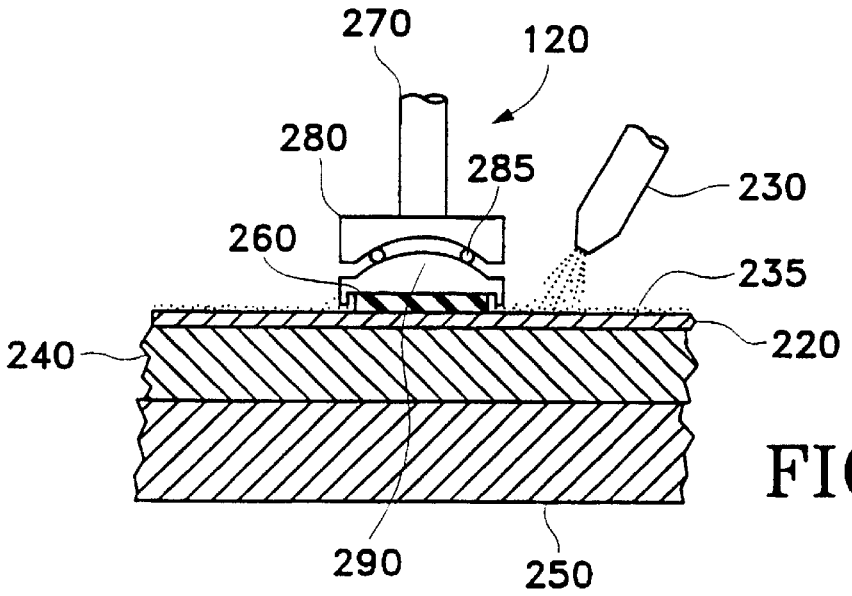
FIG. 3 is a partial cross-sectional view depicting the support platen and a polishing head.

FIG. 3 illustrates some further details of the basic polishing apparatus according to the principles of the present invention. Polishing media 220 is typically supported by support platen 250. Optional resilient pad 240 may be interposed between polishing media 220 and support platen 250 for improved polishing in certain circumstances. Polishing head 120 may have a spindle 270 to which the required downward force and rotational forces are applied. As mentioned above, polishing head 120 preferably allows for self alignment of wafer 260 to the polishing media 220. Although there are many other possibilities, polishing head 120 may allow for the rotation of lower member 290 relative to upper member 280 about a bearing means 285. Polishing fluid may be applied in metered fashion to the polishing media 220 by way of polishing fluid nozzle 230.

No matter what type of polishing head or polishing machine construction is used in conjunction with the inventive polishing media magazine, the polishing media magazine is adapted to provide increased throughput, reliability and efficiency while lowering space requirements. The various aspects of the polishing media magazine contributing to these benefits are described in detail below.

Figure 4A:
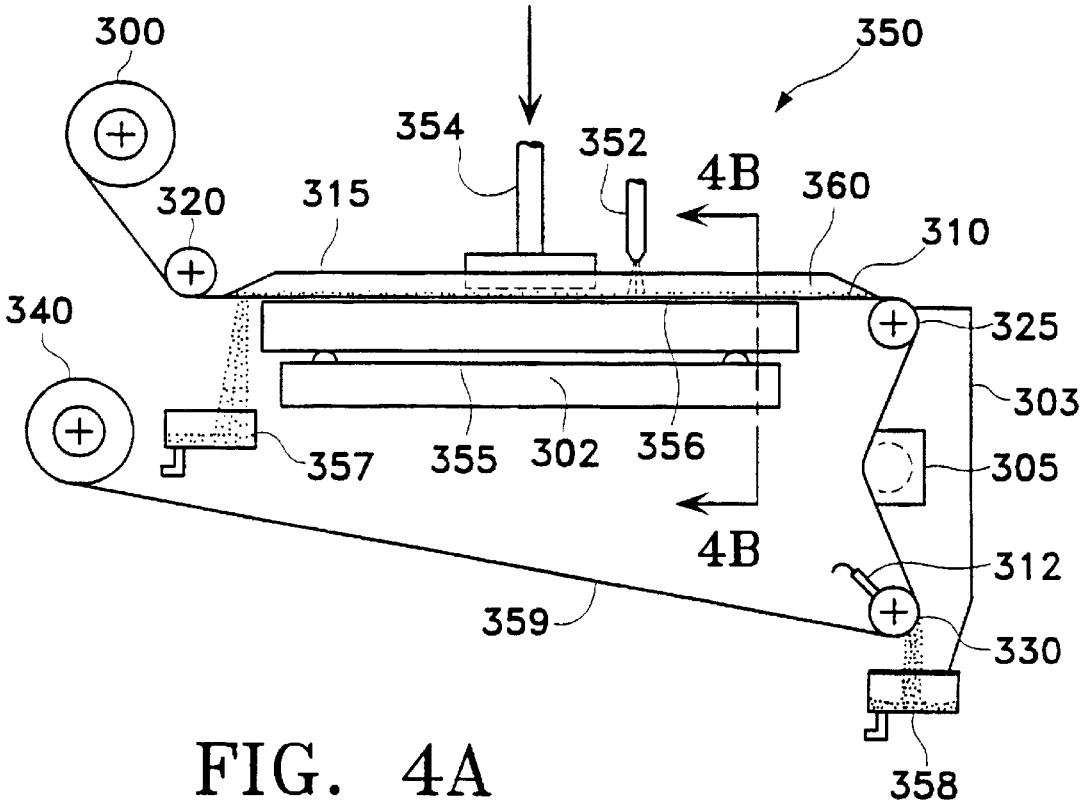
FIG. 4A is a front view of a polishing media magazine in accordance with the principles of the present invention.

FIG. 4A shows a schematic representation of a preferred polishing media magazine 350 which includes polishing fluid containment and demonstrates one embodiment of the polishing media conditioning element according to the principles of the present invention. The polishing media magazine is shown with an associated polishing head 354 and a optional polishing fluid delivery nozzle 352 for supplying polishing fluid to the polishing media 310. The polishing fluid delivery nozzle 352 may be attached to and move with polishing head 354 or may be separately located. The polishing head is shown for illustration only.

The polishing apparatus preferably uses a polishing media 310 that is supplied in the form of a long media roll. The polishing media 310 is generally comprised of a thin polymeric film substrate having either a polishing pad or a fixed abrasive covering over at least a portion of the width. The film may be on the order of 0.001 to 0.020 inches thick, preferably around 0.005 to 0.007 inches thick. The polishing media 310 should be substantially impermeable to the polishing fluid. Preferably the material is made of mylar film or polyethylene glycol terephthalate. As will be discussed in greater detail below, new polishing media 310 is automatically supplied by the polishing media magazine 350 so that user intervention is not required until the entire roll has been consumed.

The polishing media 310 may take a variety of paths through the polishing media magazine depending on the desired configuration and features desired to be interposed within the polishing media path. In one embodiment, the media is roll fed from supply roll 300 under a first rolling turnbar 320 and across top surface 356 of platen support 355. Polishing media 310 exits the top surface 356 over a second rolling turnbar 325, passes around conditioning system 305, around third turnbar 330 and finally onto take-up roll 340. The third rolling turnbar 330 is preferably located at a vertical elevation which is lower that the take-up roll 340. With this configuration, the resulting angle 359 tends to concentrate the polishing fluid at third rolling turnbar 330 for consistent release from the polishing media 310 into waste tank 358 as shown. The outer diameters of first rolling turnbar 320 and second rolling turnbar 325 are such that the polishing media is directed to be in the proper relationship with top surface 356.

The rolling turnbars (320, 325, and 330) are elements used to allow the polishing media path to change directions (i.e. turn a corner) or to ensure the polishing media is at a desired location by virtue of the fact that the polishing media path will generally be in the form of a straight line tangent between any two adjacent elements. Thus, a tensioned portion of the polishing media may be positioned accurately with respect to other features of the polishing media magazine by supporting the tensioned portion with precisely placed turnbar elements.

These turnbar elements are typically centerless ground elongated cylinders or rods supported at each end by bearings. While these rolling turnbars are typically used to reduce overall friction and wear in the system, other non-rotating elements may be employed to yield the desired polishing media path.

Whatever elements are used to form the polishing media path, it is typically desirable that the elements are sufficiently parallel to each other so that the tensioned portions extending tangentially between elements are substantially planar and so that proper polishing media steering and control may be maintained if the polishing media is to be indexed back and forth.

Figure 4B:
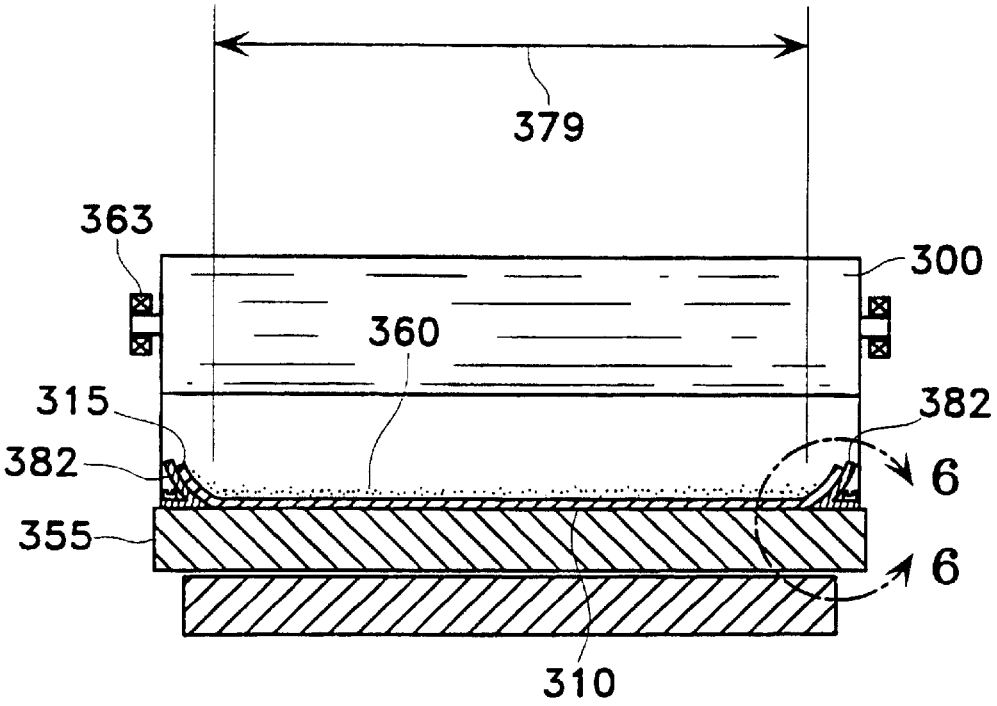
FIG. 4B is a side view in partial cross-section of the polishing media magazine taken along line 4B—4B.

Preferably, supply roll 300 and take-up roll 340 are supported at there ends by bearings (supply roll bearings 363 are illustrated in FIG. 4B) and are coupled to motors (not shown) that supply torque and controlled rotation in both a clockwise and counterclockwise direction. Typically the motors will have motor encoders and are servo driven. One or both of the motors acting on the supply roll 300 and take-up roll 340 cause the polishing media 310 to be in subjected to tensile loading. For this reason, the portion of the polishing media 310 subjected to tension, specifically the portion that is between supply roll 300 and take-up roll 340, may be referred to generally as the tensioned portion of the polishing media or the tensioned web.

Motion of the polishing media is controlled to allow the media to be indexed to any desired location. The polishing media may be advanced from the supply roll 300, through the path just described and onto the take-up roll 340. Because the diameter of the supply roll 300 changes as the polishing media is advanced out, a system of encoding that provides only the number of turns of the supply roll 300 or take-up roll 340 may be insufficient for precise positional and velocity control.

In a preferred embodiment, a separate encoder (not shown) may be attached to a rolling turnbar which contacts the polishing media. The polishing media 310 typically engages the outer diameter of the rolling turnbar and thus provides a fixed relationship between the number of turns registered by the encoder to the linear distance of polishing media movement. In a preferred embodiment, the encoder is coupled to the second rolling turnbar 325.

This encoder information may be used in conjunction with the motor encoder information for enhanced positional and velocity control of the polishing media 310. The polishing media may be advanced at any desired velocity or velocity profile. Further, the polishing media magazine may index a specific area of the polishing media 310 to any desired location in either direction.

Additional uses may be made of encoder 325. For example, by comparison of linear web tape displacement as measured by encoder 325, to the corresponding rotational displacement of the supply roll 300, measured by the supply roll 300's encoder, the radius, or material supply condition of supply roll 300 can be calculated. Calculation of the radius, or material supply condition can then be used for alarming a low material supply status.

The polishing media magazine employs some manner of determining the tension of the polishing media 310. Preferably load cell 312 is connected to the third rolling turnbar 330. Load cell 312 makes it possible to accurately determine the tension imparted to the web by the motors (not shown) connected to one or both of the supply roll 300 and take-up roll 340. The required tension in the polishing media may be up to about 300 pounds or more.

The ability to control the tension of the polishing media, when used in conjunction with the capability of precise position and velocity control allows the polishing media magazine 350 to advance any area of the polishing media 310 at a desired velocity while maintaining any desired tension. The polishing media thus has the capability to be advanced through the inventive conditioning element at a constant velocity and tension, thus ensuring uniform and consistent conditioning, as will be discussed more fully below.

One important aspect of the polishing media magazine invention is the ability to contain polishing fluids during processing. Referring again to FIGS. 2A, 2B and 3, polishing fluid 235 applied to polishing media 220 tends to get splashed around as the relative polishing movements described above are performed during polishing. For this reason the support platens are constructed to have a planar center region 144 adapted for polishing operations and raised edge features 142 for polishing fluid containment. Although the position of raised edge features 142 depend on the geometry of the support platen, they are preferably arranged in an opposing relationship along each lengthwise edge of the support platen.

As the polishing media 310 passes across upper surface 356 of platen support 355 opposing edges of the polishing media are urged upwards to provide raised edges 315 of polishing media 310. These raised edges serve to advantageously contain the fluid 360 to the polishing area. Fluid containment in this manner provides for a thicker layer of pooled fluid 360 on the polishing media 310 and at the same time does not allow the fluid to be thrown or splashed around by the relative movement between polishing head 354 and polishing media 310. This area of the tensioned web that is supported by upper surface 356 of platen support 355 is the process area in which the work piece is polished.

Raised edges 315 of polishing media 310 are preferably constructed to have sufficient height above upper surface 356 such that, in operation, fluid never spills or splashes over the raised edges. This ensures that fluid 360 is never allowed to wick between polishing media 310 and the upper surface 356 of support platen 355. This eliminates the possibility of any buildup of dried fluid under the polishing media 310 which would tend to cause polishing defects. If a resilient pad (not shown) is optionally added on top of the upper surface 356, such containment ensures that any adhesives used to secure the pads will not be attacked by the fluid.

For polishing head velocities of up to 1000 mm per second a raised height of at least 0.25 inches is sufficient. For higher head velocities of up to 3000 mm per second the raised height should preferably be 0.50 inches or more, most preferably greater that 0.75 inches.

In a preferred embodiment, the fluid is allowed to exit in a controlled manner from the polishing media near the first turnbar 320 and/or the second turnbar 325. This controlled exit of fluid allows for continual exchange of used fluid for fresh, chemically reactive and uncontaminated fluid without any intervention or down time. Fluid exit is accomplished by simply allowing the fluid to fall from the front surface of polishing media 310.

The arrangement of turnbar 330 below the take-up roll 340, thus creating the slight angle 359, allows for convenient and controlled recapture of used polishing fluid in waste tank 358. A second waste tank 357 may be employed to capture used polishing fluid that exits near first turnbar 320.

Figure 5:
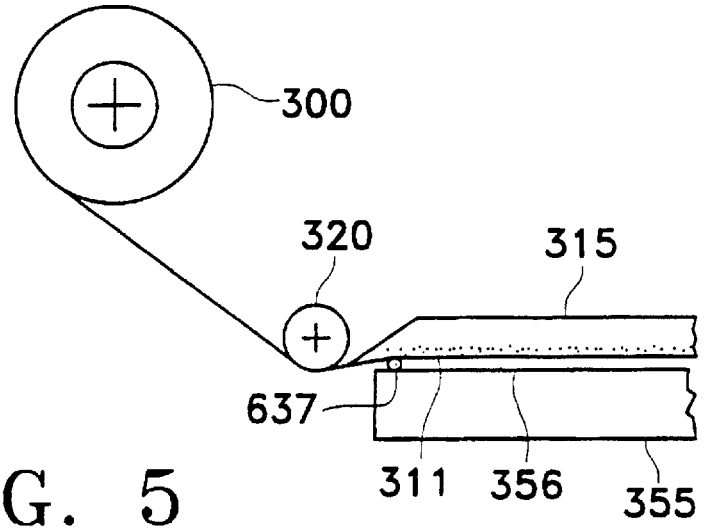
FIG. 5 is a partial plan view of one end of a preferred embodiment of the polishing media magazine apparatus of FIG. 3.

A preferred embodiment illustrated in FIG. 5 shows that waste tank 357 can be eliminated by urging the polishing medial to form a transverse raised section 311. Transverse raised section is created by the placement of a transverse urging means under the polishing media near first turnbar 320. Although the transverse urging means may take many forms, one simple construction includes the use of a transverse rod 637. Transverse rod 637 is selected to raise the media a sufficient amount above platen support 355 so as to not allow fluid to pass by it towards first turnbar 320. Preferably transverse rod 637 has a diameter of about 0.125 to 0.375 inches but may be greater as required to prevent polishing fluid from passing to first turnbar 320.

In one alternative to the transverse rod 637, the entire polishing media magazine 350 may be tilted relative to ground horizontal such that the fluid runoff is biased towards either the first turnbar 320 or the second turnbar 325. It may also be desirable to employ transverse rod 637 in conjunction with tilting the polishing machine.

FIG. 4B shows a partial cross-section of polishing media magazine 350 of FIG. 4A. For clarity the polishing head is not shown. The polishing media 310 with raised edges 315 is shown in cross-section. In this view it is seen that the media need only have a working area for polishing as wide as the planar section between raised edge sections 315. The working width 379 required may be important, for example, if the polishing media 310 is required to be coated with expensive treatments. The area outside of the working width need not be coated, thus saving material expense.

Support platen 355 is shown having raised portions or features which aid in creating raised edges 315 of polishing media 310. Means 382 for urging the edges of polishing media 310 to a raised elevation are schematically shown in FIG. 4A. These features may take several forms, examples of which are depicted in FIGS. 6A through 6D.

Figure 6A:
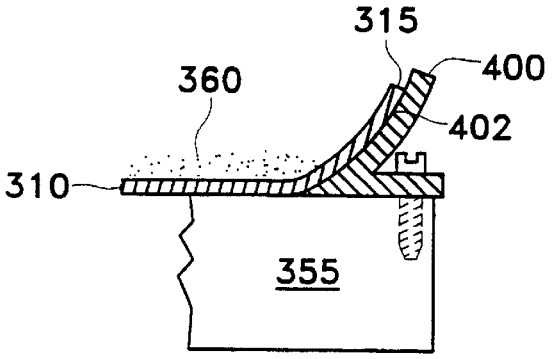
FIGS. 6A–6D are partial cross-sectional views of various constructions of the raised platen feature according to the principles of the present invention.
Figure 9:
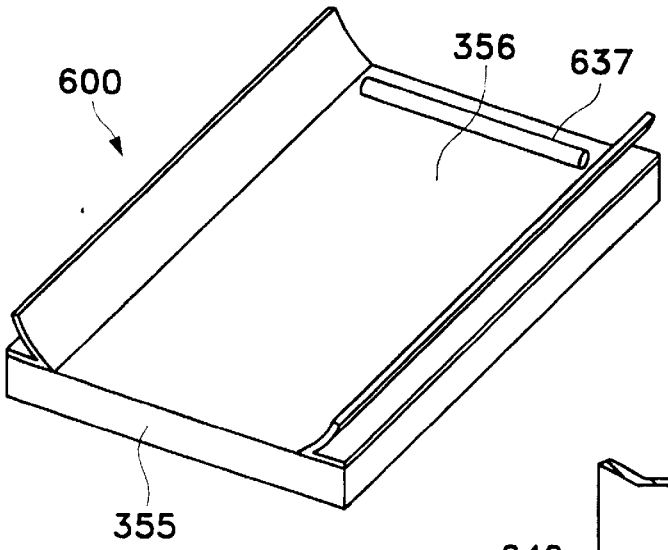
FIG. 9 is a perspective view of a platen and full length raised features.
Figure 10:
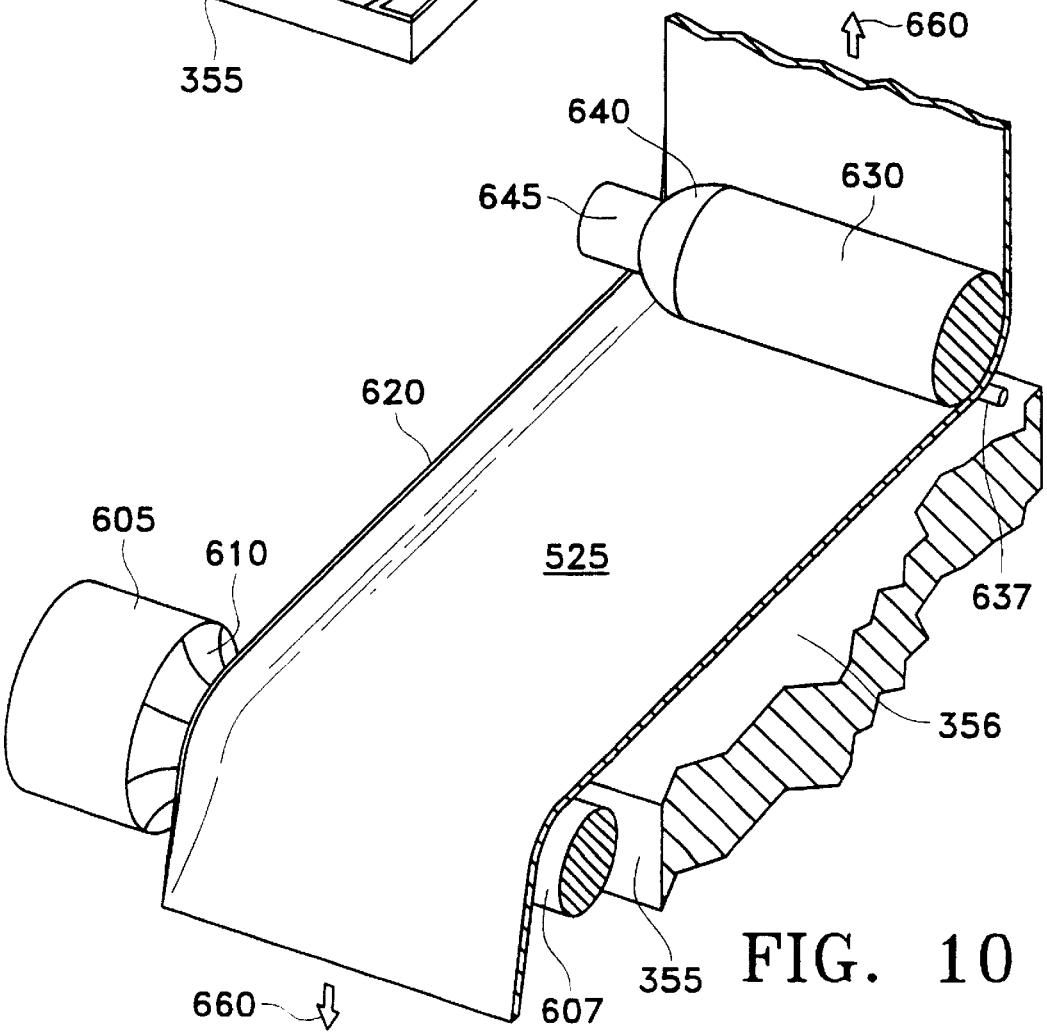
FIG. 10 is a partial perspective view of an embodiment of the polishing fluid containment apparatus.

In the preferred embodiment shown in FIG. 6A, for example, raised edge 315 is created by raised element 400 which has a radially shaped face 402. Radially shaped surface 402 preferably extends down substantially the entire length of both sides of platen 355 as shown in FIG. 9. FIG.

9 further illustrates transverse rod 637 which extends across the transverse width of platen 355.

Figure 6B:
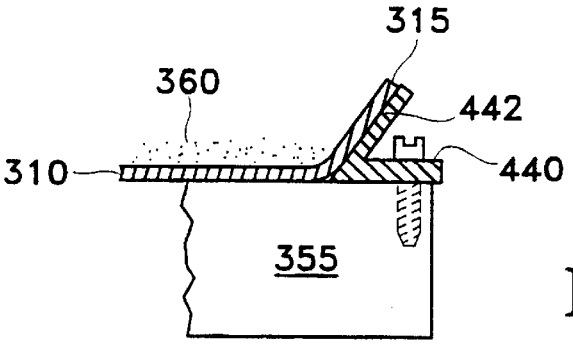
Figure 7:
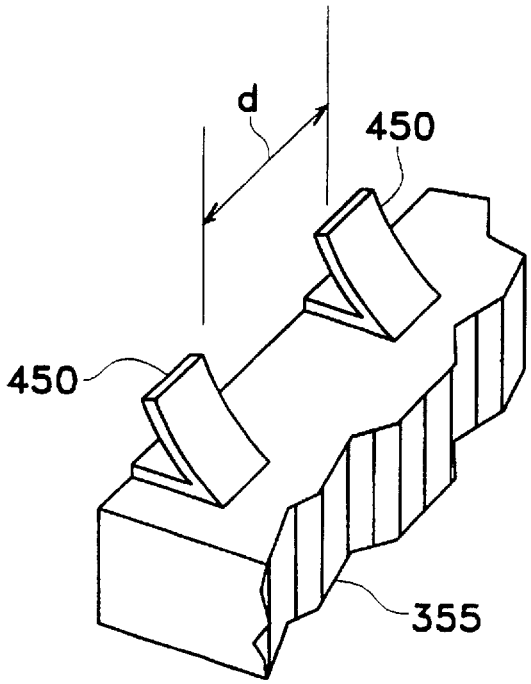
FIG. 7 is a partial perspective view showing alternate raised platen features.
Figure 8:
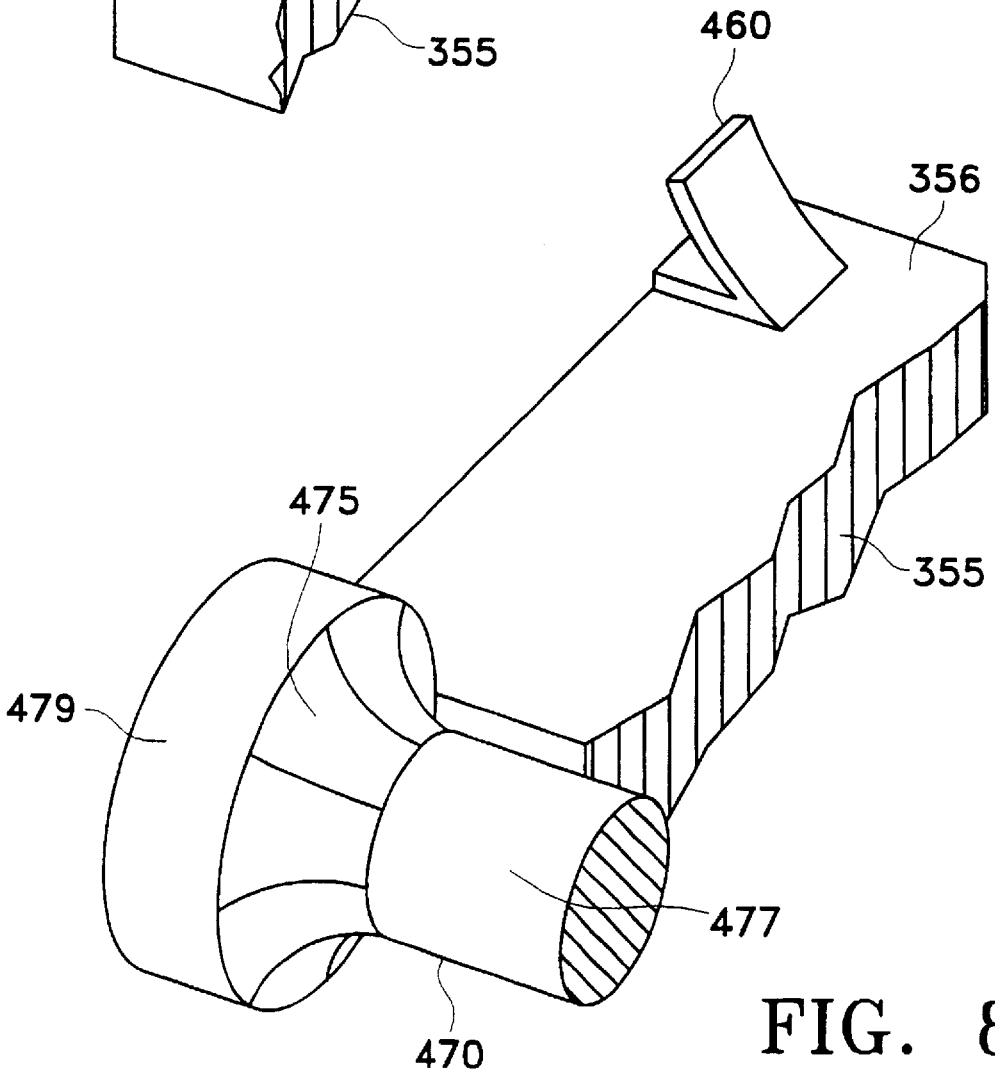
FIG. 8 is a partial perspective view of a further embodiment according to the principles of the present invention.

In FIG. 6B, raised edge 315 is created by raised element 440 which has a straight face 442 extending upwardly at an angle. These features may extend along the entire length of the support platen 355 or may be used over just sections spaced at intervals d as shown in FIG. 7. The number of raised elements and their spacing d depend on the properties of the polishing media 310, the severity of the shape of the raise edge portion, and the tension applied to the polishing media 310.

Figure 6C:
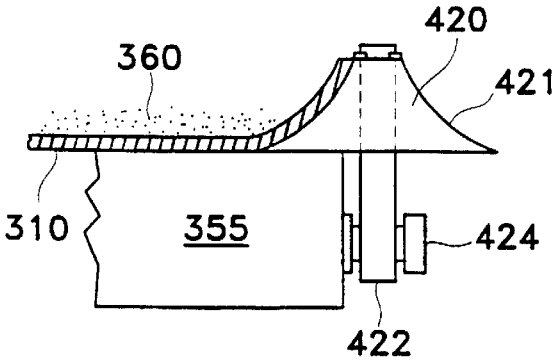
Figure 6D:
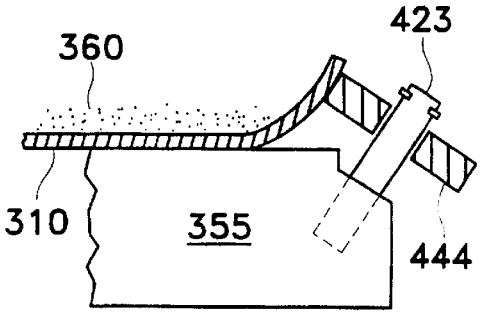

FIGS. 6C and 6D show examples of how raised edge 315 may be created using rollers. FIG. 6C for example shows a roller 420 having a contoured face 421. In one embodiment, the contour is radially shaped. The roller 420 is supported by axle 422. FIG. 6D illustrates a more conventional roller 444 supported by an angled axle 423. Rollers may have certain advantages in reducing the frictional drag of the polishing media 310 as it moves past the various elements.

In all the illustrative constructions of the raised features, the polishing media 310 best takes the shape imposed by the raised features or rollers upon application of a sufficient amount of tension in the polishing media to overcome its beam strength which tends to hold it in the flat shape. As described above, such tension can be readily applied in a controlled manner by way of torqueing the supply roll 300 or the take-up roll 340 or both.

In addition, the polishing media may be formed with sufficient residual stress in the material so as to be predisposed to form the desired fluid containment shape as it comes off the supply roll 300. In other words, the polishing media may be preformed with the desired edge shapes and then wound flat onto a supply roll. As the polishing material 310 is advance from supply roll 300, the polishing media returns to its preformed shape.

One further embodiment that especially takes advantage of the tension available in the supply and take-up rolls is shown in FIGS. 8 through 12. The embodiments in FIGS. 8 through 12 employ at least one rolling turnbar which has an increasing or decreasing diameter section. Rolling turnbar 325 of FIG. 4A for example can be constructed according to the depiction of stepped turnbar 477 in FIG. 8. Turnbar 477 has a first diameter essentially tangent to upper surface 356 and a second larger diameter 479. Contoured surface 475 transitions turnbar diameter 470 to enlarged diameter 479. This stepped turnbar 477 in conjunction with at least one raised feature 460 forces the polishing media into the desired shape having raised edges for polishing fluid containment. The raised feature 460 could be of any construction that urges the media edge upwards.

Further, with the polishing media path illustrated in FIG. 4A it is preferred to have a platen assembly 600 which includes full length raised sections 402 and transverse rod 637 as well as a first turnbar 630 having a decreasing diameter section and a second turnbar 607 having an increasing diameter section. Turnbar 630 has a contoured surface 640 that transitions a first larger diameter down to a smaller diameter 645. The larger diameter is constructed to be roughly tangent with upper surface 356 of the platen support 355.

Turnbar 607 has a contoured surface 610 that transitions a first smaller diameter up to larger diameter 605. For turnbar 607, the smaller diameter is constructed to be tangent with upper surface 356 of the platen support 355. Contoured surfaces 640 and 610 operate alone or in conjunction with raised elements 402 to urge the media into a polishing fluid containing shape having a raised edge 620. The media readily takes such shape upon the application of tension in the polishing media in the direction of arrows 660.

Another important aspect of the inventive polishing media magazine is the ability to provide a uniform conditioned or cleaned polishing surface to facilitate improved polishing. According to the principles of the present invention, providing a uniform conditioned polishing area is accomplished, at least in part, by way of a conditioning element that spans the entire width of the surface desired to be conditioned.

Such a conditioning element may be in the form of a rotating element placed in the path of the tensioned web or an element that is capable of traversing a predetermined pattern over the area to be condition. Although certain non-contact conditioning elements may be employed, the conditioning element is preferably adapted to be in forced contact with the polishing media such that relative motion caused by movement of the tensioned web or the conditioning element imparts the necessary conditioning work to the polishing media. The various configurations and advantages of such conditioning elements are described in detail below.

In some cases, for example when the polishing media is a fixed abrasive media, it may be sufficient to use only spray nozzles to remove polishing debris and liberated particulate from the polishing media in preparation for polishing.

After a certain amount of polishing on a given area of the polishing media 310 various conditions may develop that adversely effect polishing or cause polishing defects. For example the polishing media may become worn, as is the case with fixed abrasive polishing media. In some instances, the abrasive particles used on the polishing media may become dislodged into the polishing path and cause defects. In other instances, the polishing media may become impacted with the material removed during polishing, especially in combination with polishing fluid (if used).

FIG. 4A illustrates one configuration of the conditioning system 305. In this configuration, the conditioning system 305 is outside of the area where polishing occurs. This allows for easier and more reliable removal of polishing and conditioning particulate and fluids. Also, polishing media is generally in a vertical orientation in the vicinity of the conditioning system which further enhances the ability of the polishing media magazine to remove unwanted particulate or fluids from the polishing or processing area.

Figure 11:
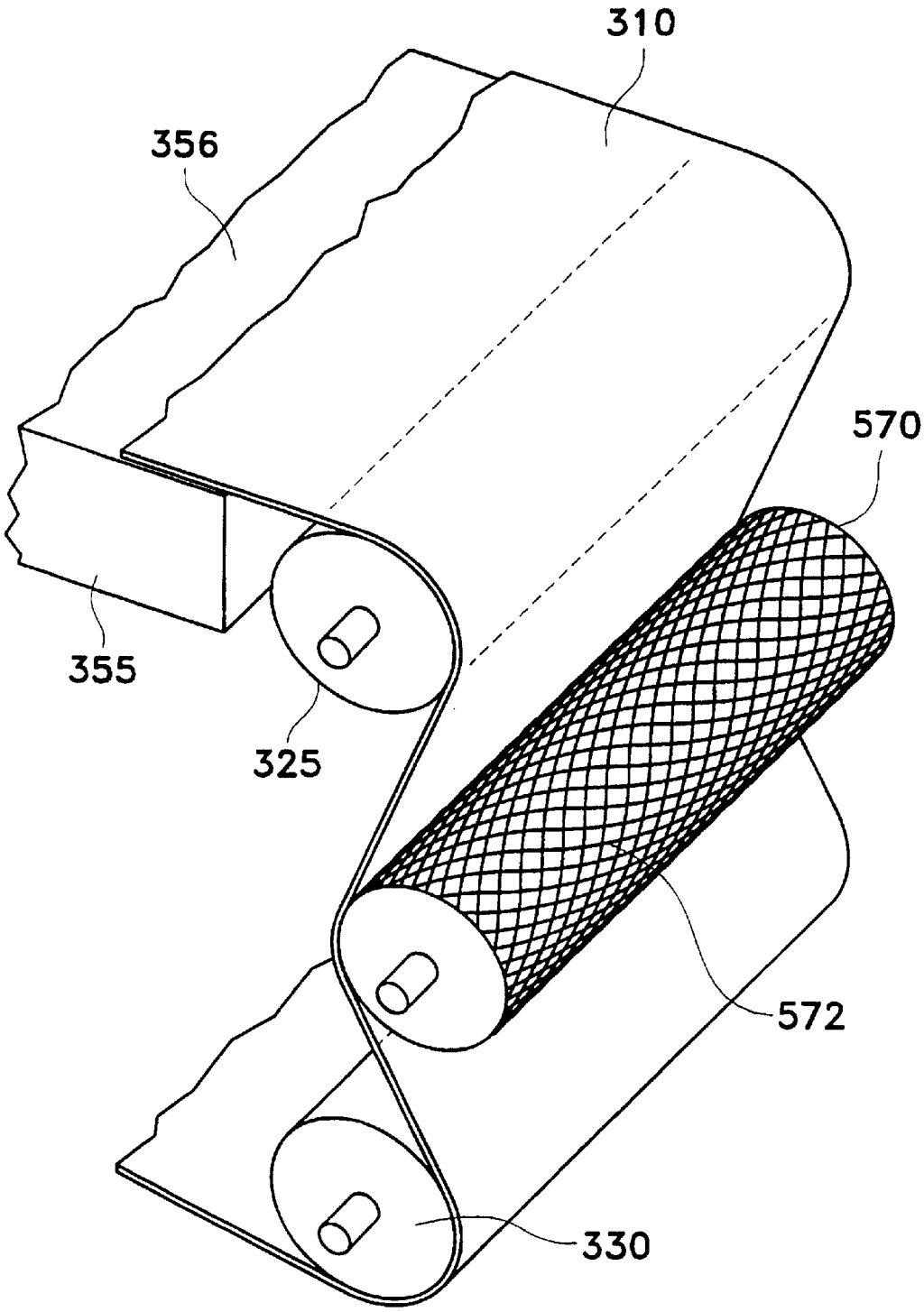
FIG. 11 is a partial perspective view showing one embodiment of a conditioning roller.

Referring to FIG. 11, one end of the polishing media magazine of FIG. 4A is shown in perspective view. Polishing media 310 is shown to extend across the top surface 356 of platen support 355 and around each of second rolling turnbar 325, roller 570, and third rolling turnbar 330.

Roller 570 illustrates one embodiment of the full width conditioning element. Roller 570 has a generally cylindrical outer surface 572 that contacts the polishing web 310. Roller 570 is coupled to a motor (not shown) and is typically servo driven to provide control of the conditioning roller 570's rotational speed over a wide range of settings. Roller 570 may be rotated in either the clockwise or counterclockwise direction, at any desired velocity as the polishing media 310 is advanced past, such that the desired relative velocity between the roller 570 and the polishing web 310 is obtained.

Preferably, the motion of both the polishing media 310 and the outer surface 572 of roller 570 are at constant velocities. This arrangement ensures that the relative velocity between the outer surface 572 and every point across the width of the polishing media 310 remains constant throughout the conditioning cycle.

The outer surface 572 is typically treated, or textured to provide the desired conditioning effects to be imparted on polishing media 310. The treatment of outer surface 572 is selected primarily according to the result desired for the final conditioned surface of polishing media 310. For example, if the polishing media used is a fixed abrasive, a surface geometry will be selected that will free impacted particulate from the abrasive particles bonded to the surface of the polishing media with minimal abrasive detachment or dulling. In other cases, it may be desirable to abrade, texture or planarize the surface of the polishing media in addition to removing impacted particulate.

In a preferred embodiment, such surface geometry is created by diamond coating the outer surface 572 of roller 570. Such a surface treatment is especially useful when the polishing media 310 is made of an elastomeric or polymer type material. The abrasive particle size and density of the diamond coating can be selected such that to meet the particular conditioning requirements of the polishing media 310 in use.

An alternate manner of providing the desired surface geometry is by machining or etching the desired pattern onto the outer surface 572. The surface geometry could then be hardened or coated to improve the wear resistance of the conditioning element. The geometry could be hardened by any appropriate hardening process such as induction heating, carburizing, nitriding, ionnitriding, or by the application of surface coatings such as quartz, aluminum oxide, silicon carbide, or cubic boron nitride, or other such coatings or processes that may become available.

Figure 12:
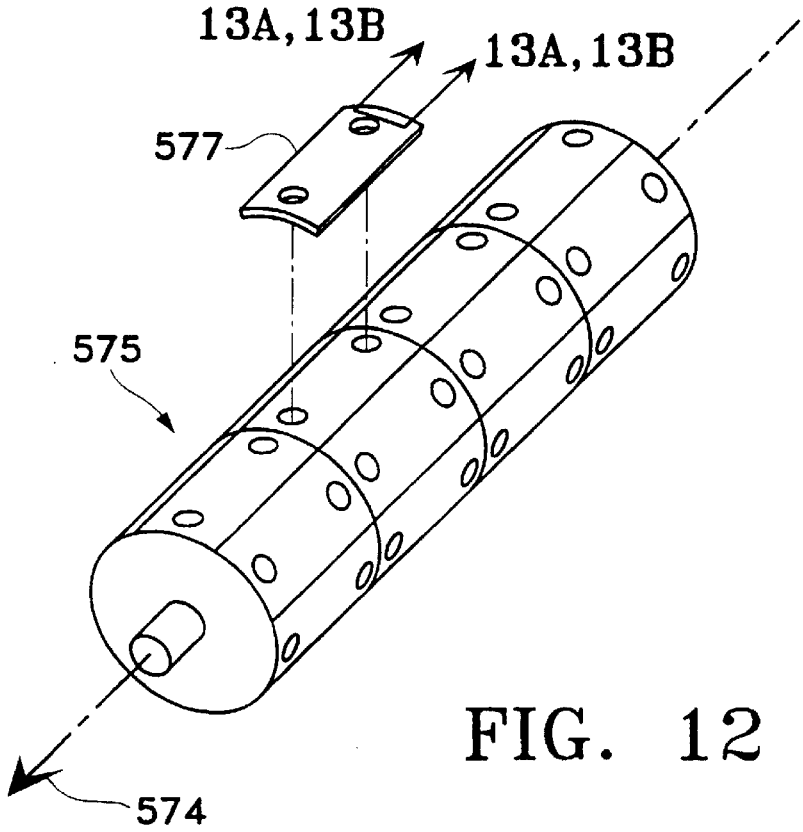
FIG. 12 is a perspective view of an alternate construction of the conditioning roller.

Because some of these treatments and coatings may be difficult to manufacture evenly over entirety of a cylindrical surface, it may be desirable to use the construction shown in FIG. 12. FIG. 12 shows a conditioning roller 575 constructed of a number of shells element. Shell element 577 is shown separated from the conditioning roller 575. Each shell element may be processed individually allowing for easier manufacturing of the shell element itself, as well as the desired surface geometry. In addition, any of the shell elements may be individually replaced if it becomes worn or damaged.

Figure 13A:
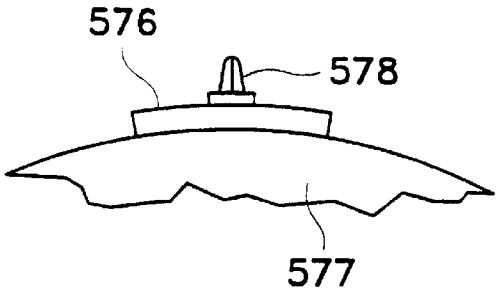
FIGS. 13A is a partial cross-sectional view along line 13A—13A as shown in FIG. 12 showing one construction of conditioning roller surface features.
Figure 13B:
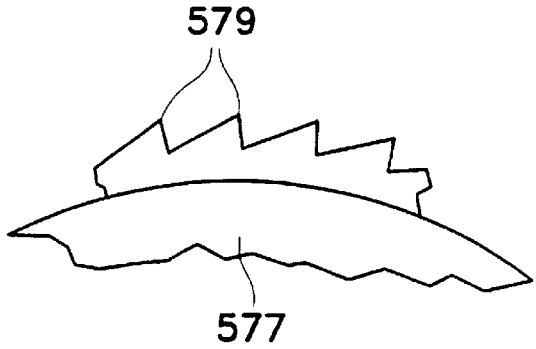
FIGS. 13B is a partial cross-sectional view along line 13B—13B as shown in FIG. 12 showing an alternate construction of conditioning roller surface features.

FIGS. 13A and 13B illustrate additional geometries that may be placed on the surface of the conditioning roller, especially when the shell construction is used. For example, an array of singular points may be used to create the desired surface geometry. FIG. 13A illustrates one such surface point 578. Surface point 578 may be attached to mounting pad 576 provided on shell element 577. FIG. 13B shows an alternate construction of the surface geometry. In this construction or shell element 577, the surface geometry may include a series of ridges 579 that are generally parallel to operating axis 574 or roller 570. When the conditioning roller 575 is rotated about its operating axis 574, such ridges will operate to planarized the polishing media.

Figure 14:
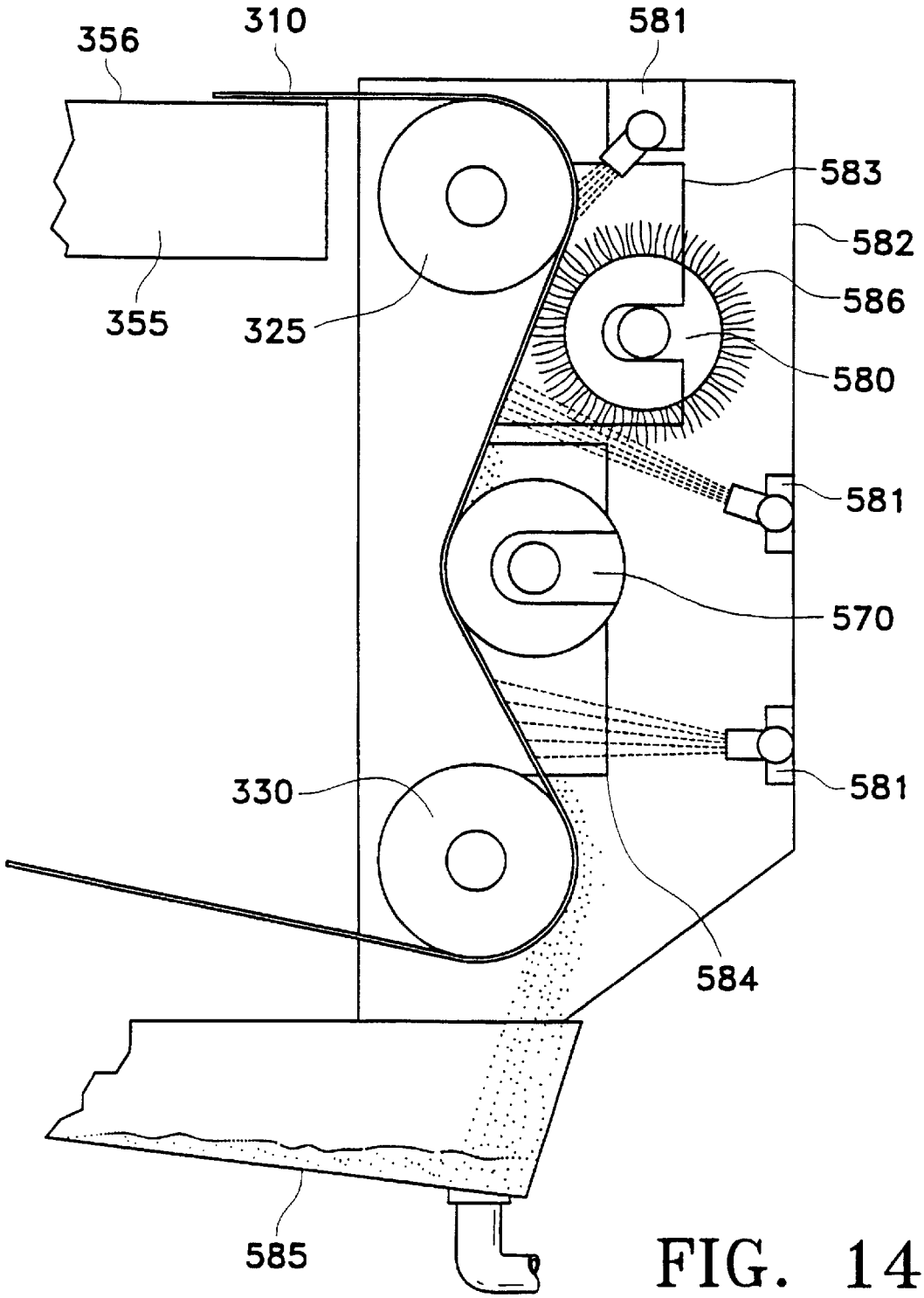
FIG. 14 is a partial front view showing a preferred embodiment of the conditioning element according to the principles of the present invention.

In some instances it may be desirable to further clean or condition the polishing media over and above what is provided by roller 570 alone. FIG. 14 shows yet another embodiment of the polishing media magazine according to the principles of the present invention that provides for additional cleaning or conditioning. The polishing media 310 is again under tension and takes the same path over the upper surface 356 of platen support 355 and then around second rolling turnbar 325, roller 570 and third turnbar 330. Roller 570 may be constructed according to the discussion above and is forced contact with the polishing media 310.

Referring to FIG. 14, one way of providing additional cleaning or conditioning is by implementation of rotating brush 580. Rotating brush 580 is constructed with a sufficient number of bristles 586 extending radially outwardly from the center axis. The bristles 586 are trimmed to provide a uniform, concentric brush element. Rotating brush 580 is placed in proximity to the tensioned web such that the tips of the bristles are in sufficient contact with the surface of the polishing media. Rotating brush 580 is coupled to a motor (not shown) and is servo driven.

Rotating brush 580 may serve a number of functions depending on its construction. For example, rotating brush 580 is useful to ensure the particulate removed or created by roller 584 is not allowed to enter the processing area as the media is advanced towards supply roll 300 after polishing media 310 has been conditioned. In such cases, bristles 586 may be made from a somewhat flexible material such as natural or synthetic fibers. In a preferred embodiment, the bristle material is nylon.

Rotating brush 580 is useful not only to clean the polishing media after conditioning by roller 570, but may also abrade or texture the surface of the polishing media 310 in a similar manner as explained above with regards to roller 570. For this purpose, the bristles 586 of rotating brush 580 may be made from a relatively stiff material such as metallic wire. For example, the bristles, 586 may be made of fine music wire or stainless steel.

When rotating brush 580 is constructed to abrade, texture, or planarize the surface of polishing media 310, roller 570 may not be required. In that case the polishing media magazine may not have roller 570. In the alternative, roller 570 may in effect be deactivated by rotating it at a rotational velocity that causes outer surface 572 to have a surface velocity equal to and in the same direction as the velocity of the polishing media 310. This may also be accomplished by disengaging roller 570 from its motor drive (by way of a clutch or the like) such that roller 570 is allowed to spin freely. In that way it simply operates much as the rolling turnbars.

A number of spray nozzles 581 may be optionally employed to further enhance conditioning, prevent the polishing media 310 from drying out, and in some instances, improve the cutting or conditioning action of the roller 570. The spray nozzles may be used to augment the cleaning of the polishing media 310 by removing waste material by way of a rinsing or flushing action. The fluid used in this operation by the spray nozzles 581 may be any suitable cleaning agent or chemical agent. In normal use deionized water is used as the cleaning media at a pressures of around 30 to 50 psi, however if a more aggressive cleaning action is desired a specialized high pressure spray system may be employed allowing pressures ranging from 200 to 2,000 PSI. The pressure used for a more aggressive spray system is limited by the durability of the polishing pad material in use, such that no physical damage would be imparted into the pad material via the high pressure spray.

The number and spacing of spray nozzles 581 are dependent on the spray pattern of each nozzle. It is desirable to have an adequate and uniform amount of fluid spray at each point across the full width of the polishing media 310 to accomplish the desired cleaning. As some of the deionized water or other chemical cleaning agents may be expensive, it is desirable to not use too many nozzles, or have the spray pattern of each significantly overlap.

Typically, nozzles are placed every 3–6 inches across the width of the polishing media. Individual nozzles may each be supplied with the desired fluid by individual hoses from a common fluid source. It may also be advantageous to use a spray bar (not shown) or manifold, having a common reservoir running across the width of the polishing media magazine having each nozzle of a given row in fluid communication with the common reservoir. Preferably, the amount and direction of fluid spray from each nozzle is adjustable.

In constructing the conditioning system of FIG. 14, care must be taken to ensure that the cleaning fluids, as well as any polishing fluids, are adequately contained. End cover 582 is provided to prevent fluids from splashing to other areas of the polishing media magazine or polishing machine. Brush end shield 583 and roller end shield 584 are provided near each side edge of the polishing media 310 to ensure that the fluids are not allowed to reach the back side of polishing media 310. Excess fluid is collected for recycling or disposal in waste tank 585.

Figure 15:
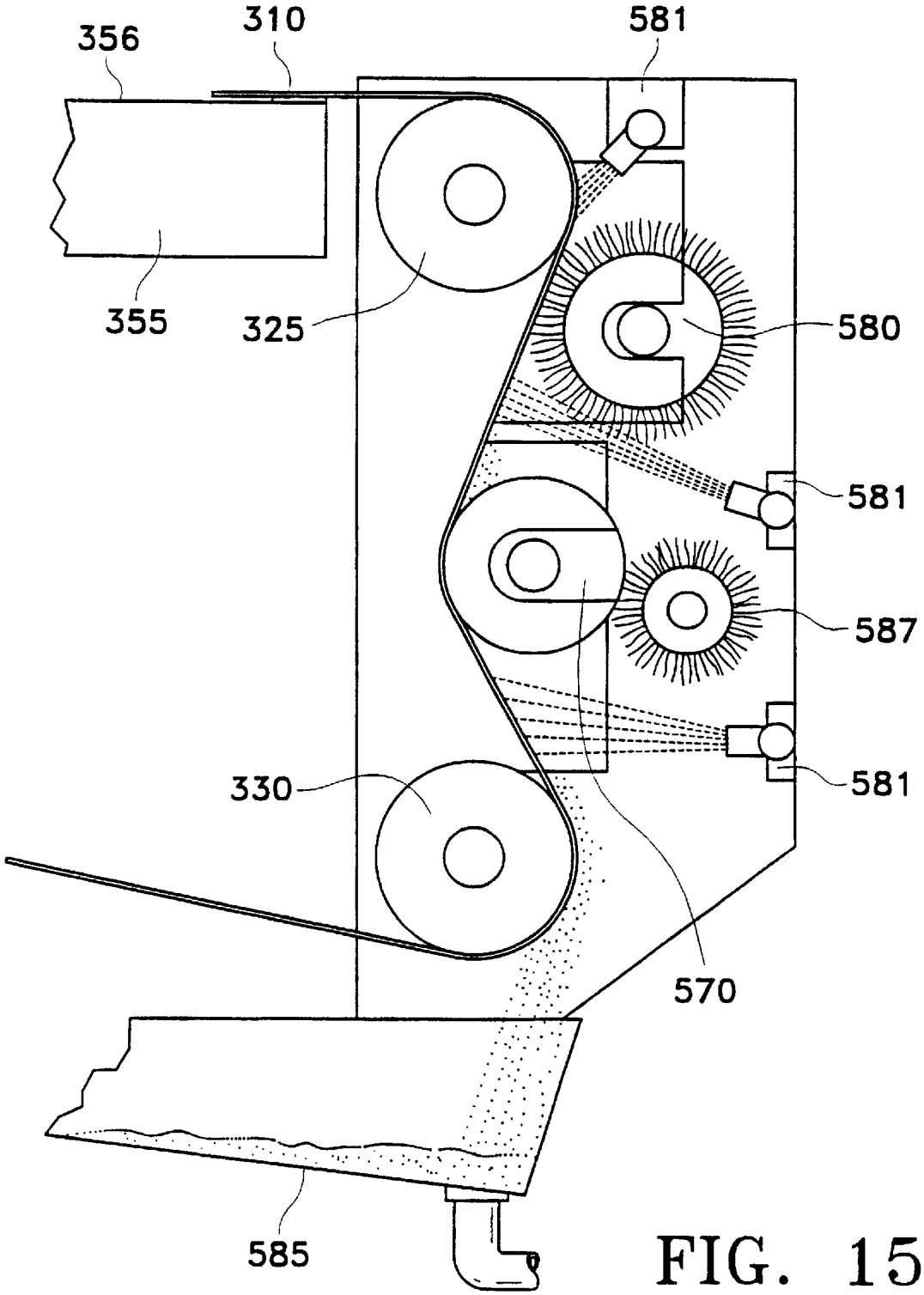
FIG. 15 is a partial front view showing an optional construction of the conditioning element.

FIG. 15 shows an optional embodiment of the apparatus just discussed. In this embodiment an optional rotating brush 587 is employed to clean roller 570. Optional rotating brush 587 may be useful to eliminate any buildup of impacted conditioning particulate or debris on roller 570 which would tend to cause conditioning irregularities. In cases where an abrasive has been applied to the outer surface 572 of roller 570, optional rotating brush 587 may also aid in removing any abrasive particles that have become loosened from roller 570 during conditioning. Optional rotating brush 587 is constructed in a similar manner as described above for rotating brush 580.

Figure 16:
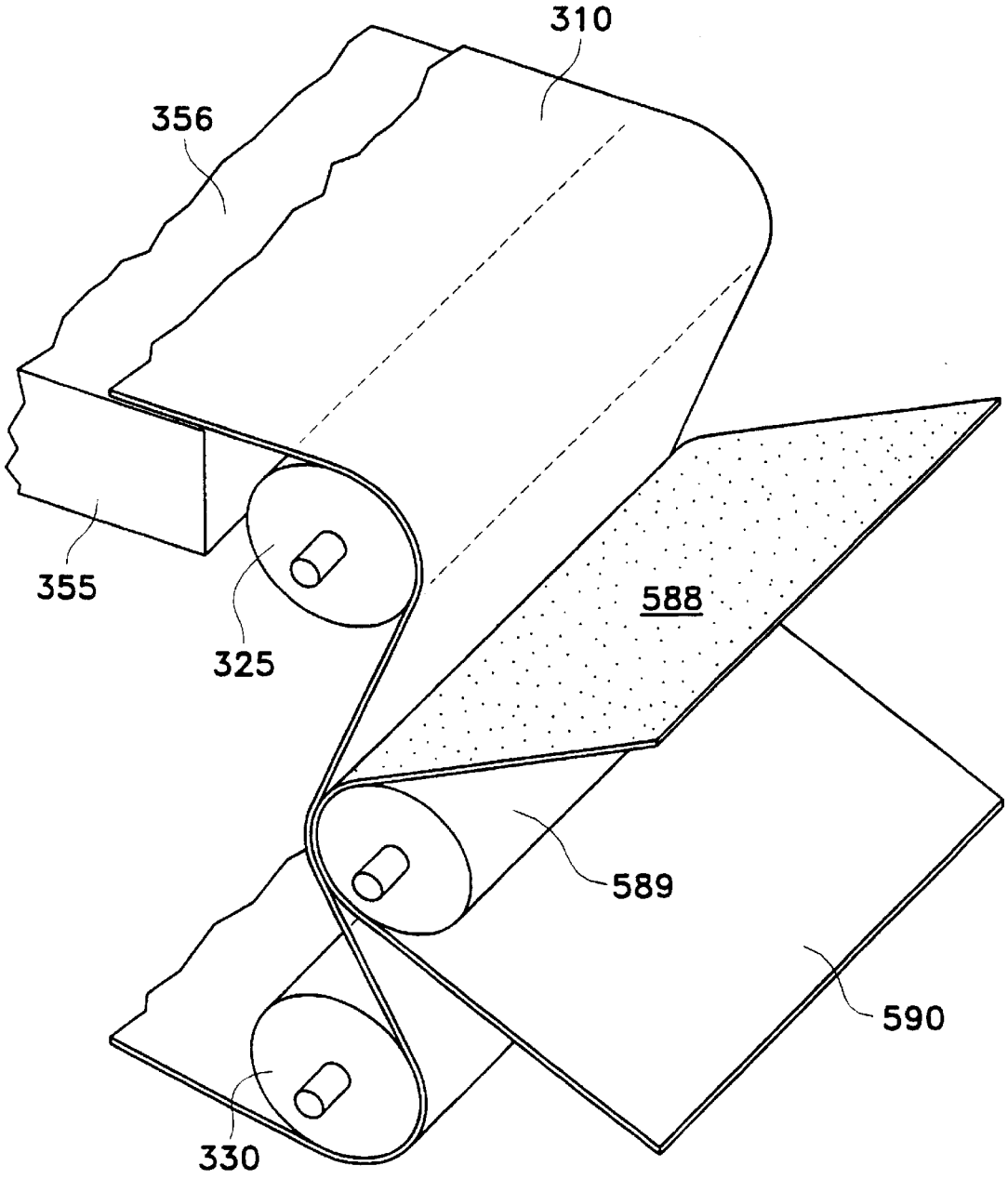
FIG. 16 is a partial perspective view of an alternate conditioning element.

The inventive polishing media magazine may employ other types of conditioning elements in place of roller 570. As already mentioned above, a rotating brush alone may be sufficient. FIG. 16 shows another embodiment of a full width conditioning element. In this embodiment, roller 570 is replaced with support roller 589 and section of conditioning media 590 which may be advanced at a relative velocity to the polishing media 310. Conditioning media 590 may be supplied in a roll (not shown) and be held in tension between the conditioning media supply roll and a conditioning media take-up roll (not shown). Alternatively, conditioning media 590 may be in the form of a continuous belt supported by two or more support rollers similar to support roller 589. The appropriate surface geometry may be more easily applied to front surface 588 of conditioning media 590 when in a flat state prior to winding on a supply roll or configured as a continues belt.

As with any of the full width conditioning elements described above, one feature of their operation is that they are in forced contact with the polishing media; this being required to impart the necessary work to the polishing media. This forced contact results from the geometrical relationships and tension of the polishing media in relation to the conditioning element as illustrated in FIG. 17.

Figure 17:
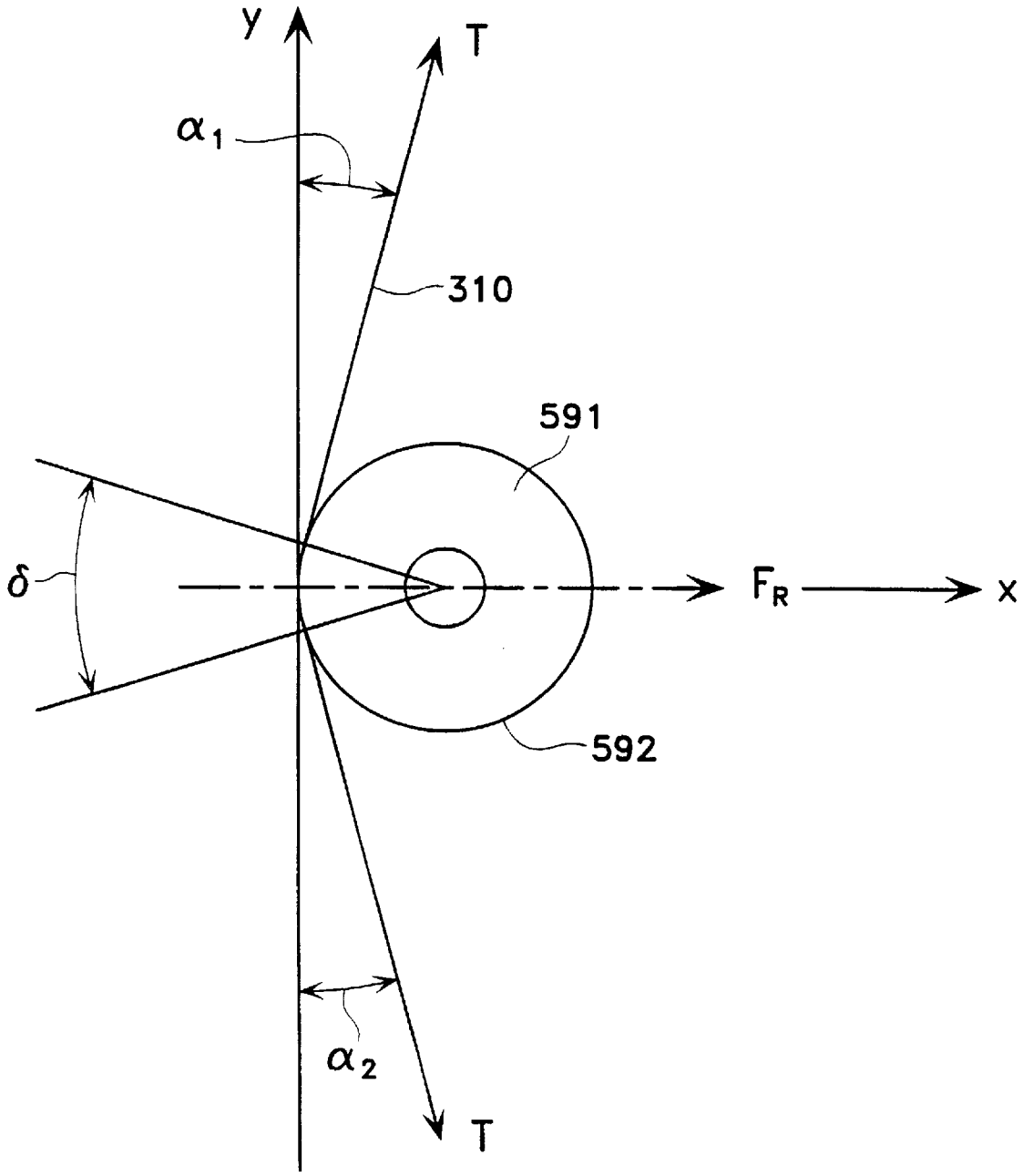
FIG. 17 is a diagrammatic representation of the tension and resultant force acting on the conditioning roller.

FIG. 17 shows full width conditioning element 591 in a forced contact relationship with polishing media 310. The conditioning element 591 has cylindrical outer periphery surface 592. Outer periphery surface 592 would generally includes a surface geometry for conditioning the polishing media 310. Polishing media 310 wraps around conditioning element 591 forming an area of contact. The area of contact is determined by the angle of contact (δ) between the polishing media 310 and the conditioning element 591, and the width of the polishing media 310.

The tension in polishing media 310 creates a resulting force, $F_R$ acting on the conditioning element 591, for which the direction and magnitude can be approximated by solution of the freebody diagram. Given the XY coordinate system shown, the X and Y components of the two tension vectors can be resolved, allowing calculation of an approximate solution for the magnitude of the resultant force $F_R$. Note in the example shown, only an approximate solution is found for the resultant force $F_R$, a more exact solution would require treatment of the resultant force as a distributed reaction load. With Fr and T expressed in the same units of force the X and Y components of the resultant force $F_R$ are found from the equations:

$$F_{R(x)}=T\ \mathrm{Sin}(\alpha_1)+T\ \mathrm{Sin}(\alpha_2),$$

and $$F_{R(Y)}=T\ \mathrm{Cos}(\alpha_1)+T\ \mathrm{Cos}(\alpha_2),$$

knowing the X and Y components of the resultant force, the magnitude of the reaction force ($F_R$) is then calculated from the equation:

$$F_R=\{(F_{R(X)})^2+(F_{R(Y)})^2\}^{1/2}$$

From these geometrical relationships illustrated in FIG. 17, the working pressure between the conditioning element 591 and the surface of the polishing media 310 may be approximated by dividing the approximated resulting force $F_R$, by the contact area. It is also apparent that the working pressure under which conditioning is to occur may be modified or controlled by changing any of the variables above.

For example, if the conditioning element 591 is forced further into the path of the polishing media, the contact area will increase in accordance with the increased entry and exit angles. At the same time, the increased entry and exit angles increase the resulting force, $F_R$ according to the formula above.

If the roller remains in a fixed position relative to the path of the polishing media, the effective working pressure between the surface of the polishing media 310 and the conditioning element 591 may be easily controlled by adjusting the tension in the polishing media. In a preferred embodiment, the tension is adjusted and controlled by supply roll 300 and take-up roll 340 in accordance with the control feedback from load cell 312 (see FIG. 4A) to achieve the desired working pressure. Of course, this working pressure is uniform across the width of the polishing media 310, ensuring uniform conditioning at all points.

Figure 18:
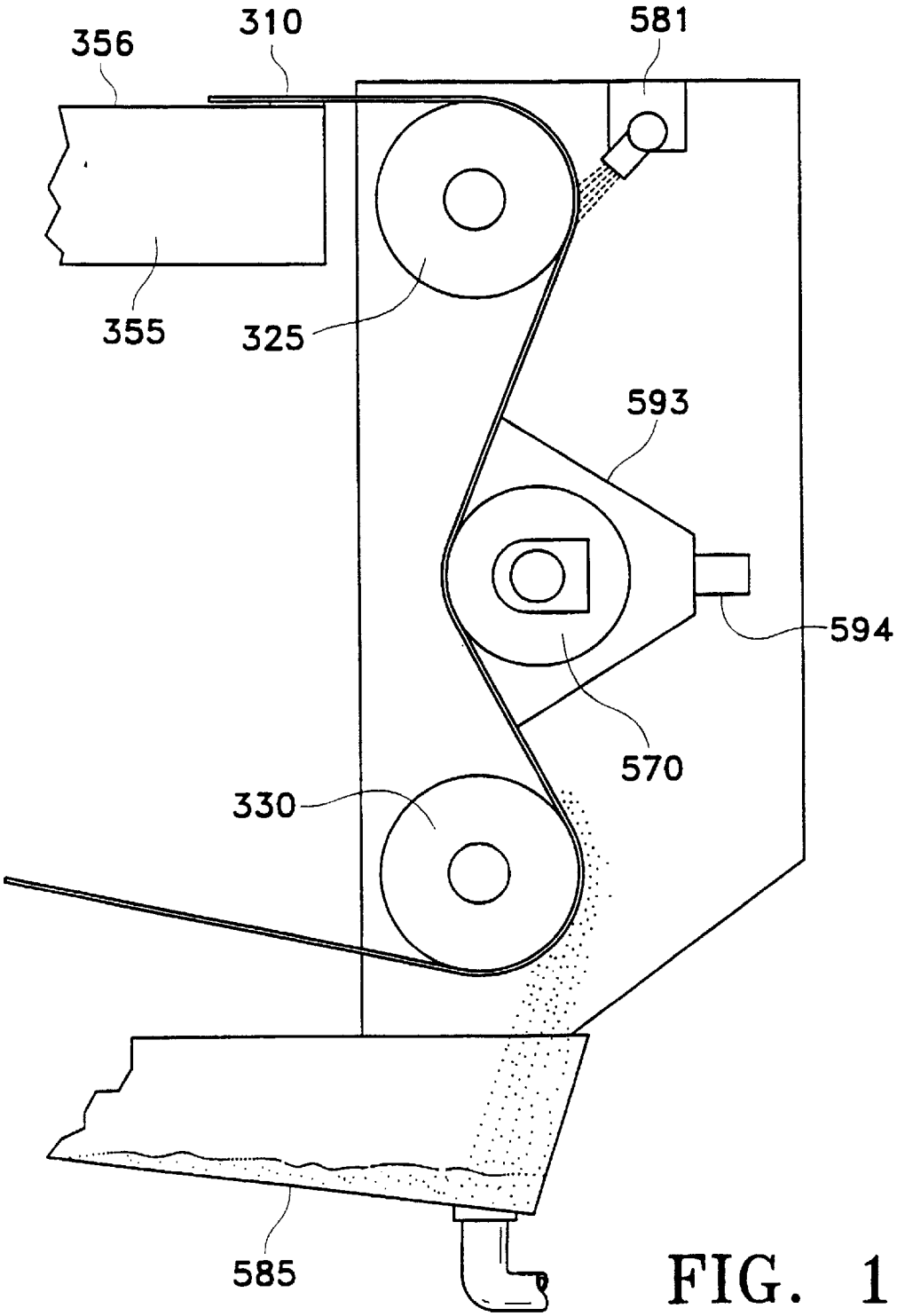
FIG. 18 is a diagrammatic representation of a front view of another embodiment of the polishing media magazine.

An alternate construction that ensures uniform working pressure across the width of the polishing media is shown in FIG. 18. Conditioning roller 570 is enclosed by vacuum plenum 593 having one or more vacuum ports 594. The plenum is positioned to contact or nearly contact the polishing media such that the polishing media 310 and the vacuum plenum 593 form a effective vacuum chamber when vacuum is applied at port 594. The amount of vacuum required at port 594 is dependent upon the desired working pressure, preferably in the range of about 0.5 psi to about 10 psi or more, most preferably about 2.0 psi. If vacuum plenum 593 is positioned to contact the polishing media, the contact interface may be made from a soft flexible plastic to minimize wear and facilitate sealing.

With this construction, the portion of the polishing media 310 exposed to the vacuum within the plenum 593 is uniformly biased, by operation of the vacuum, against the conditioning roller 570. Such a construction tends to eliminate the effects of any polishing media web tension differentials across the width and provides a working pressure control which is adjustable independent of polishing media tension or wrap angle. To completely eliminate the effects of polishing media tension at roller 570, it may be required to independently drive rollers 325 and 330 so that the tension in the web is minimized in the area between the two rollers and the working pressure is developed only due to vacuum plenum 593.

Figure 19:
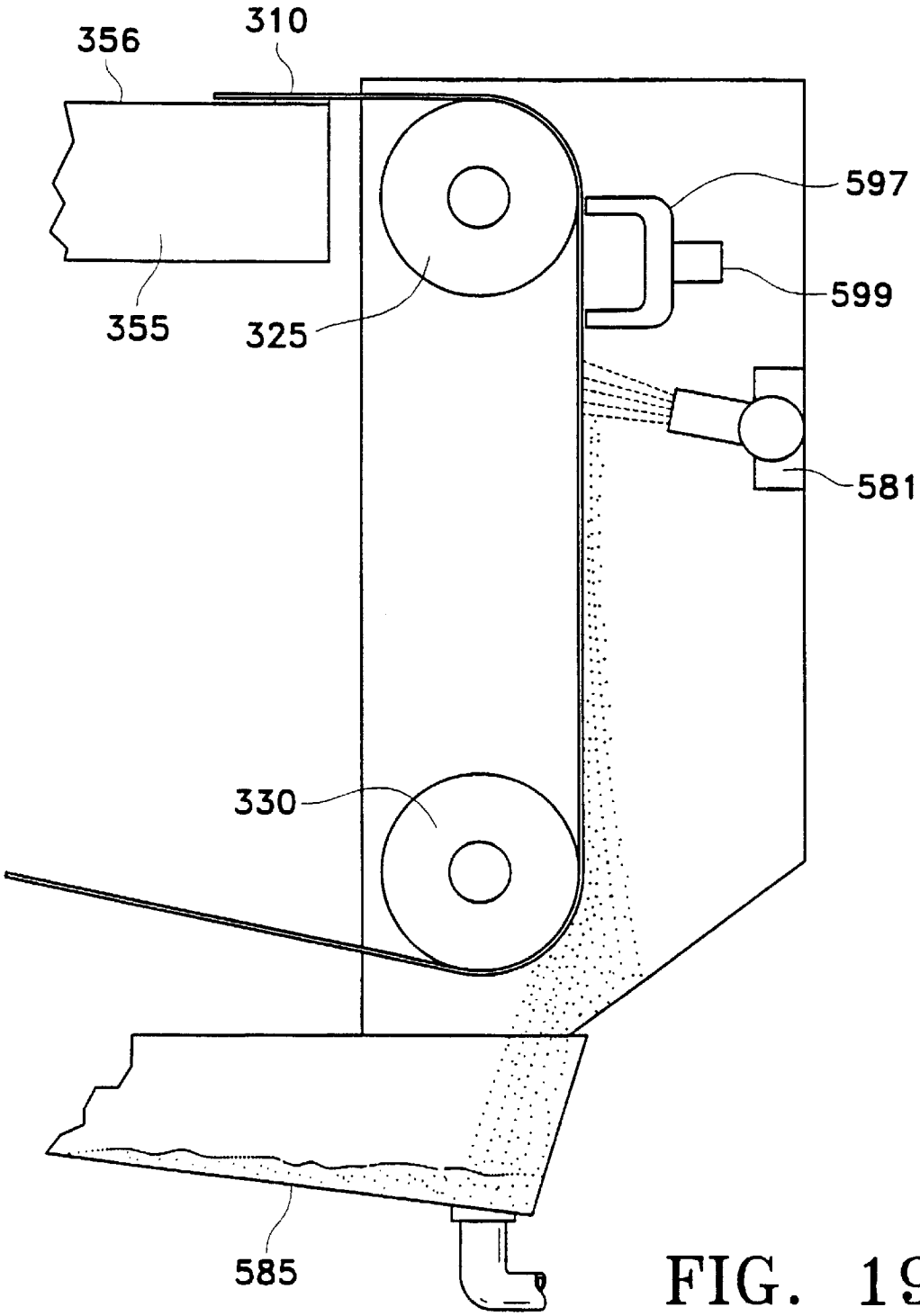
FIG. 19 is a diagrammatic representation of a front view of another embodiment of the polishing media magazine.

As mentioned above, in some circumstances the polishing media may be sufficiently prepared for polishing by action of spray nozzles alone. This is especially true when the polishing media is a fixed abrasive. Depending on the configuration, this may be accomplished by disabling the conditioning elements as discussed above or, alternatively, by the construction shown in FIG. 19. A series of spray nozzles 581 can be used to condition or clean the polishing media 310. The nozzles may operate at somewhat higher pressures of up to 250 psi or more. As the polishing media 310 is indexed towards the polishing area, it may be desirable to employ optional suction channel 597 to remove excess fluid or particulate. Suction channel 597 extends across the width of polishing media and is typically closed-ended. Suction channel 597 may be positioned to contact the polishing media or at least within close proximity to the polishing media such that the channel can effectively suction off excess fluid when vacuum is applied to vacuum port 599.

Figure 20:
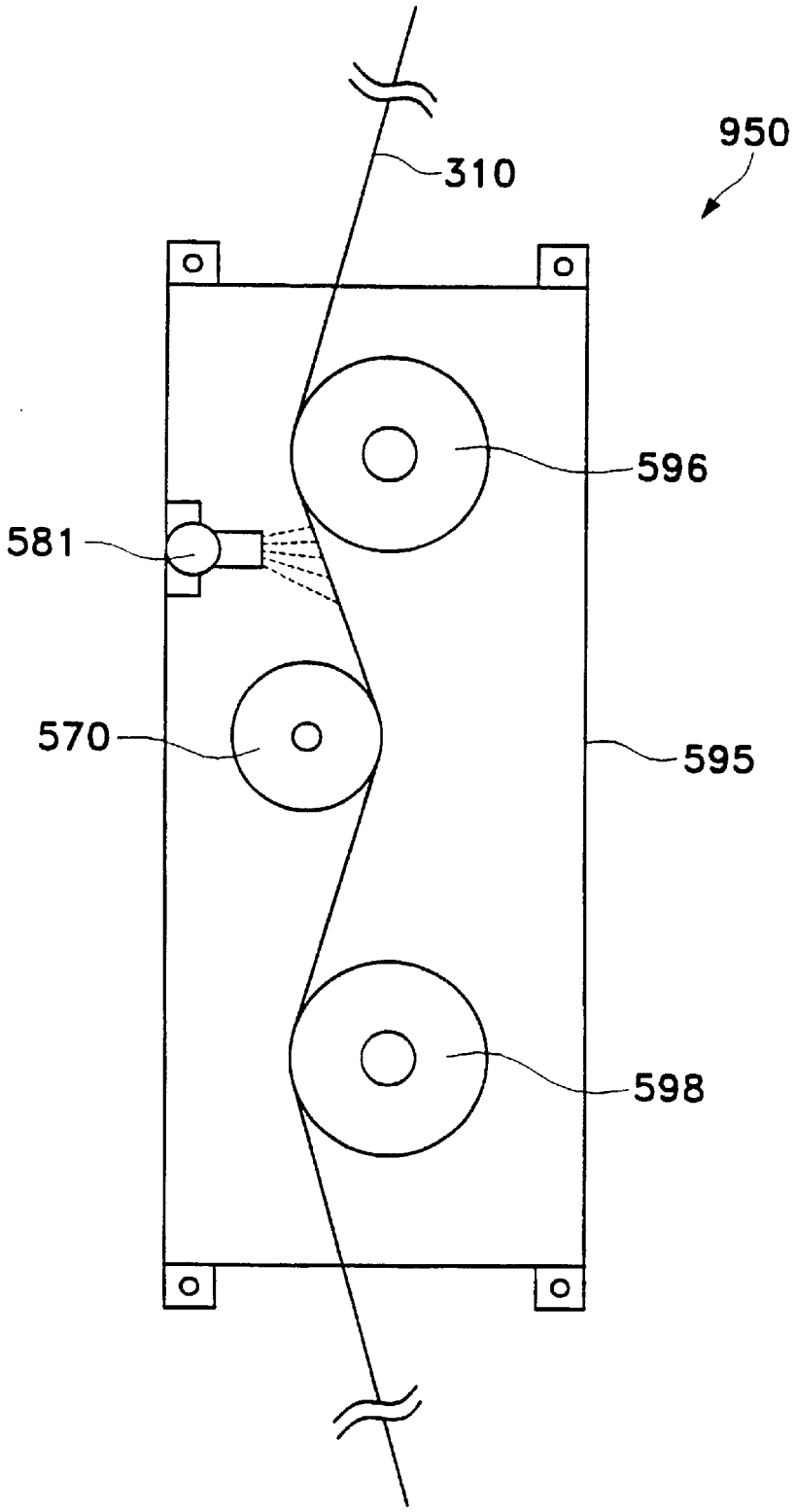
FIG. 20 is a diagrammatic representation of a front view of a conditioning module according to the principles of the present invention.

The principles discussed above for the various conditioning and cleaning constructions could also be utilized in a stand alone conditioning module as shown in FIG. 20. Conditioning module 950 is adaptable for inline installation in any suitable machine having the appropriate polishing media. Conditioning module 950 may use any of the features discussed above with regards to the polishing media magazine including conditioning roller 570 and spray bars 581. To facilitate installation into the polishing media path of an existing system, the conditioning module typically includes upper roller 596 and lower roller 598 which provide the desired wrap around conditioning roller 570. The upper and lower rollers 596 and 598 are typically servo driven rollers that control the motion and tension of the polishing media during conditioning. The proximity of the driving rollers to the conditioning roller tends to result in better tension control at the conditioning roller.

In operation, the polishing media magazine advances or indexes an area of the polishing media 310 that is to be used in the polishing process at a constant velocity past the conditioning and cleaning elements described above. With the conditioning roller and/or brush rotating also at a constant velocity governed by their respective servo motors, the relative surface velocities are at all times constant.

After the tape has indexed past the conditioning and cleaning elements, the direction of the polishing media 310 is reversed, and the area of polishing media is advanced back, or nearly back to its original starting position. In the instance where the polishing media 310 is reversed nearly back to its original position, minus only a small incremental distance, the polishing media is continually renewed by way of the small incremental advance of media between each conditioning operation. During this rewind phase, the rotating brush may continue to operate to ensure removal of any liberated particles as a result of conditioning. With this operation under constant velocity and constant working pressure, the polishing media magazine provides for a substantially continuous supply of uniformly conditioned polishing surface.

Figure 21:
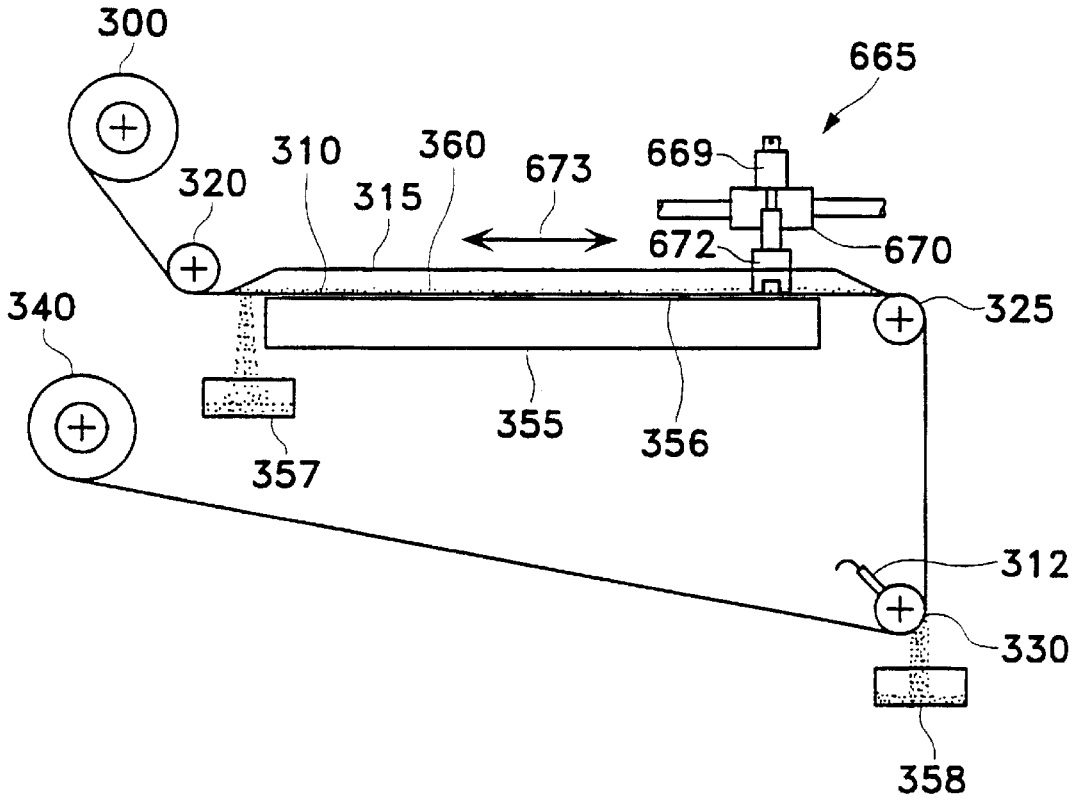
FIG. 21 is a diagrammatic representation of a front view of an alternate embodiment of the polishing media magazine according to the principles of the present invention.

Another construction of the polishing media magazine providing a continual supply of uniformly conditioned polishing media is shown diagrammatically in FIG. 21. Instead of moving the polishing media 310 past a conditioning system interposed within the tensioned web, FIG. 21 illustrates the use of an conditioning system 665 configured to traverse the polishing media 310 according to a predetermined or preprogrammed pattern. In a preferred embodiment, the conditioning system traverses the portion of the tensioned web that is supported by the platen support 355. At least a portion of this area is the area where polishing is to occur.

Conditioning system 665 generally involves a full width conditioning head 672 and a head support structure 670. The conditioning head 672 may be in the form of a rolling element or a flat bar type element having surface geometry for conditioning the media or may be any non-contact conditioning system including ultrasonic, megasonic transducer, pressure water spray, or other non-contact agitation or finishing system.

Preferably the conditioning head 672 employs surface geometry created in the manner described above. In that case, the conditioning head 672 is forced into contact with the polishing media 310 by linear actuator 669 or similar device. Head support structure 670 allows movement to and from the surface of the polishing media and typically allows for some alignment of the conditioning head relative to the surface of the polishing media 310.

The conditioning head is capable of traversing the polishing media in the general plane of the polishing media 310 supported by upper surface 356 of platen support 355. Conditioning head 672 is movable along a first direction indicated by arrow 673 (generally perpendicular to the longitudinal axis of the supply roll) and in a second direction perpendicular to arrow 673. Selective motion in these two directions makes it possible to have the conditioning head 672 traverse any desired pattern or path over the surface of the polishing media 310. Such patterns may also be created over the polishing media by a system that allows the polishing media 310 to move in a first direction indicated by arrow 673 and the conditioning element to move in a second direction perpendicular to arrow 673.

Figure 22:
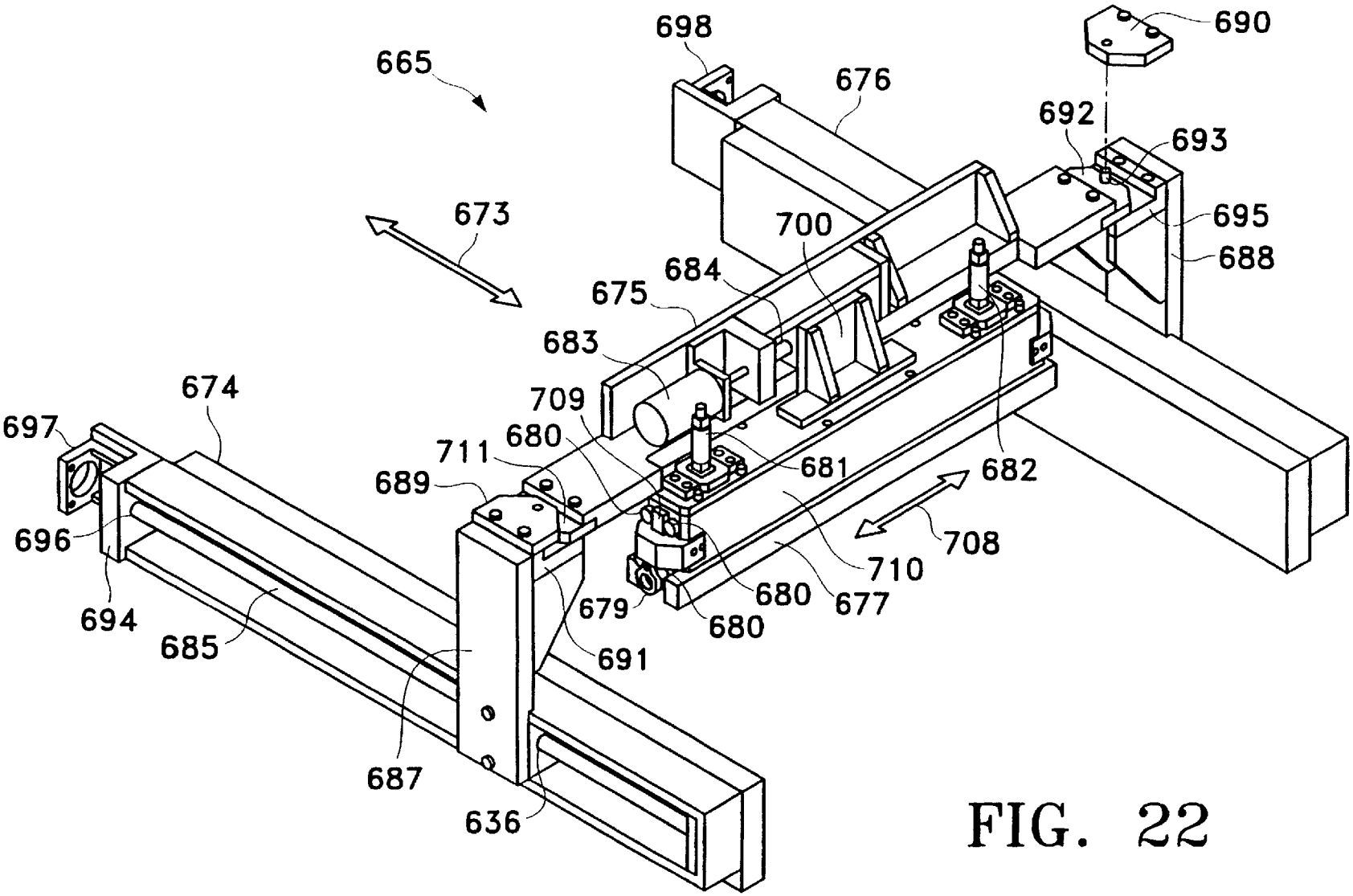
FIG. 22 is a partial perspective view showing the details of an alternate embodiment of the conditioning element.

FIG. 22 is a perspective view showing the details of the conditioning system 665. Conditioning head 677 is constrained with a pivot coupling at head bushing 679 to head alignment body 709. Head alignment body 709 is supported by head carriage assembly 710 and left end rollers 680 and right end rollers 678 (shown in FIG. 23) which are contained in head carriage assembly 710. Head alignment body 709 and conditioning head 677 are allowed motion in sufficient degrees of freedom within the head carriage assembly to allow the head to be forced downward into the polishing media and to allow the head to self-align to the surface of the polishing media.

Linear actuators 681 and 682 are mounted to head carriage assembly 710. Linear actuators 681 and 682 act on head alignment body 709 to force the conditioning head into contact with the polishing media such that the desired working pressure is generated for conditioning. Preferably, the actuators are linear air actuators, but any means of providing such downward force would be acceptable.

Figure 23:
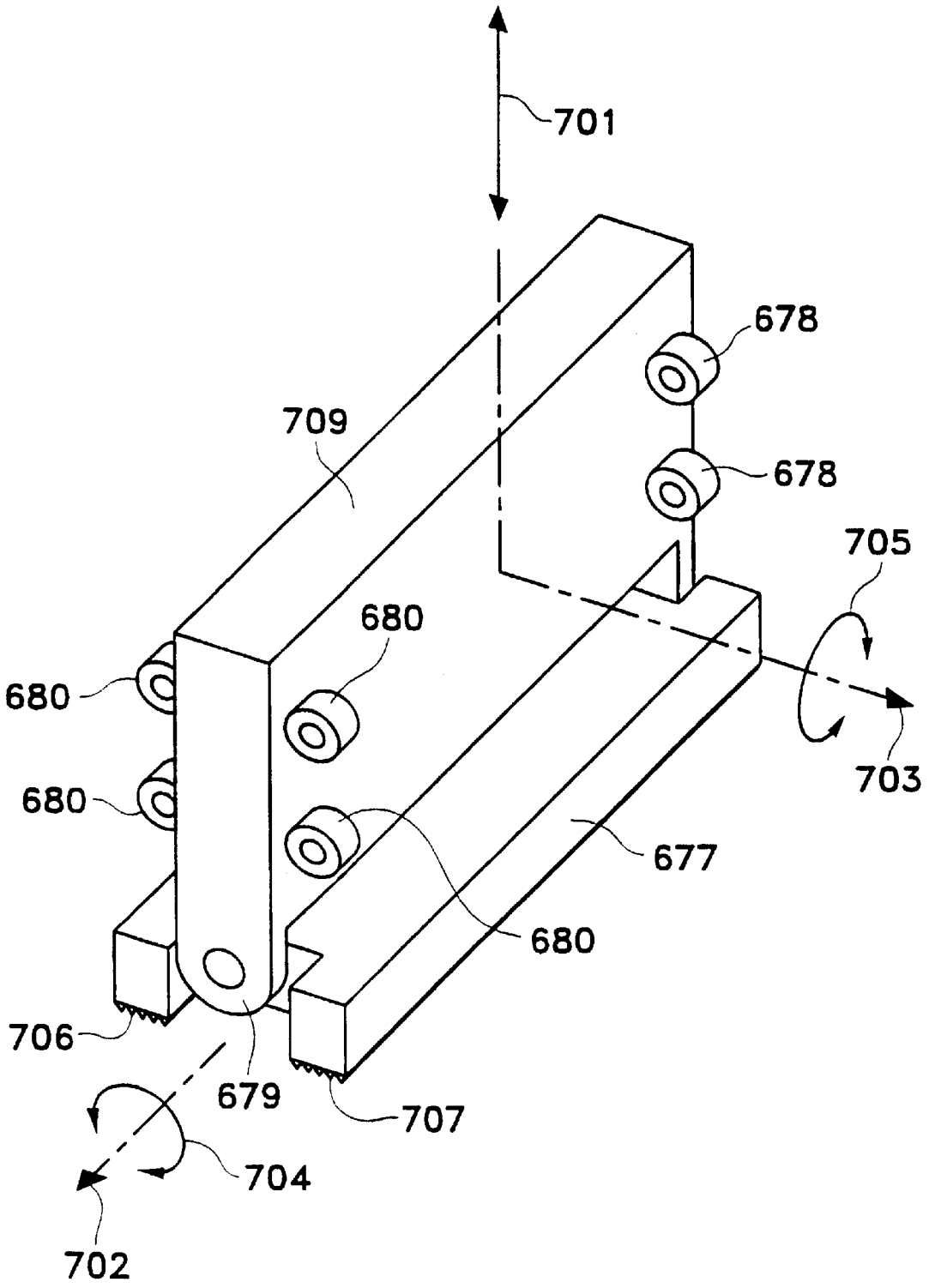
FIG. 23 is a diagrammatic representation in perspective view of the conditioning element of the embodiment shown in FIG. 22.

The self-aligning head arrangement is more clearly shown in FIG. 23, which shows the support structure for the head alignment body 709. Left end rollers 680 and right end rollers 678, coupled to the head carriage assembly 710, guide the head alignment body for free movement in the direction shown by arrow 701 (towards and away from the polishing media) yet still allowing the head to align itself to the polishing media.

Conditioning head 677 preferably has a front conditioning element 707 and a rear conditioning element 706, although many other arrangements are possible. Each conditioning element is constructed to have the desired surface geometry for conditioning the polishing media.

One axis of alignment rotation is provided as conditioning head 677 pivots about bushing axis 702 generally as shown by arrow 704. A second axis of alignment rotation of the head alignment body 709 is generally at the center of head alignment body 709 as the left and right end rollers (680 and 678) allow rotation about center axis 703 as shown by arrow 705. As the head alignment body 709 is forced downward into contact with the polishing media, the contact pressure of the front conditioning element 707 and the rear conditioning element 706 is equalized as the conditioning head 677 rotates about bushing axis 702 and the head alignment body rotates about center axis 703 as required. Thus, conditioning will occur under a constant pressure at all points across the width of the polishing media.

Referring again to FIG. 22, head carriage assembly 710 is coupled to transverse support 675. Head carriage assembly 710 is allowed to move in relation to transverse support 675 in the direction indicated by arrow 708, generally referred to as transverse motion.

Transverse motion of head carriage assembly 710 may be accomplished with any appropriate drive assembly. In the preferred embodiment, transverse motion of head carriage assembly 710 is provided by a lead screw 684 driven by transverse servo-motor 683. Lead screw 684 is threaded through brace 700 which is rigidly attached to head carriage assembly 710. The transverse servo-motor 683 may be accurately driven in either direction, thus providing transverse motion of the head carriage assembly 710 with any desired frequency. The head carriage assembly 710 requires only about 0.5–6 inches of total transverse motion. In the preferred embodiment a total transverse travel of about 2 inches is provided.

Transverse support 675 is connected to left vertical support 687 and right vertical support 688. Vertical supports 687 and 688 are slidably attached to left support base 674 and right support base 676. Left support base 674 and right support base 675 are attached to the polishing media magazine on each side of the polishing media 310 such that conditioning head 677 is positioned over the polishing media in the process area.

Left support base 674 and right support base 676 have drive assemblies for moving the transverse support 675 and attached head carriage assembly in the direction indicated by arrow 673. The drive assemblies, best viewed with respect to left support base 674, include a lead screw 685 supported at or near its ends by first end bearing plate 696 in lead screw bracket 694 and second end bearing plate 699. Lead screw 685 is threaded through mating threads 686 of vertical support 687. Main lead screw servo-motors (not shown) are connected at left motor mount 697 and right motor mount 698 for coupling to lead screw 685 (and a lead screw similarly provided in right support base 676).

The head carriage assembly 710 may be driven in the direction indicated by arrow 673, by independently driving the lead screw in each support base under servo control. Since each side of transverse support 675 is driven independently of the other, a protective coupling mechanism may be provided to attach the transverse support 675 to left and right vertical supports 687 and 688. The protective coupling mechanism is adapted to prevent damage to the conditioning system 665 that would otherwise occur if the independent servos where incorrectly driven (i.e. one lead screw driven in one direction and the other driven in the other direction).

In a preferred embodiment of the protective coupling mechanism, the transverse support 675 includes right coupling member 692 which has an open-ended slot. Right coupling member 692 is coupled to the right vertical support by way of support block 695 and drive pin 693. Support block 695 bears the weight of transverse support 675 and head carriage assembly. Drive pin 693 is received by the open-ended slot of right coupling member 692. Driving forces imparted to the right vertical support 688 is transferred to right coupling member 692 through drive pin 693. If the lead screw drives are improperly driven, the drive pin releases from the open end of the slot. Right retaining cap 690 is bolted into place to secure the transverse support against the reaction loading as the conditioning head 677 is forced against the polishing media by linear actuators 681 and 682. The same mechanism is shown assembled with regards to the left vertical support 687, left support block 691, left coupling member 711, and retaining cap 689.

Conditioning system 665 provides for movement of the conditioning head 677 over the processing area and polishing media. Conditioning head 677 may be programmed to traverse the length of the processing area in the direction indicated by arrow 673 and at the same time may move in the direction indicated by arrow 708 in any desired pattern. In this manner, each point on the conditioning head over the width of the polishing media traverses an identical path, at an identical velocity, under equalized pressure. The result is highly uniform conditioning of the surface of the polishing media.

Figure 24B:
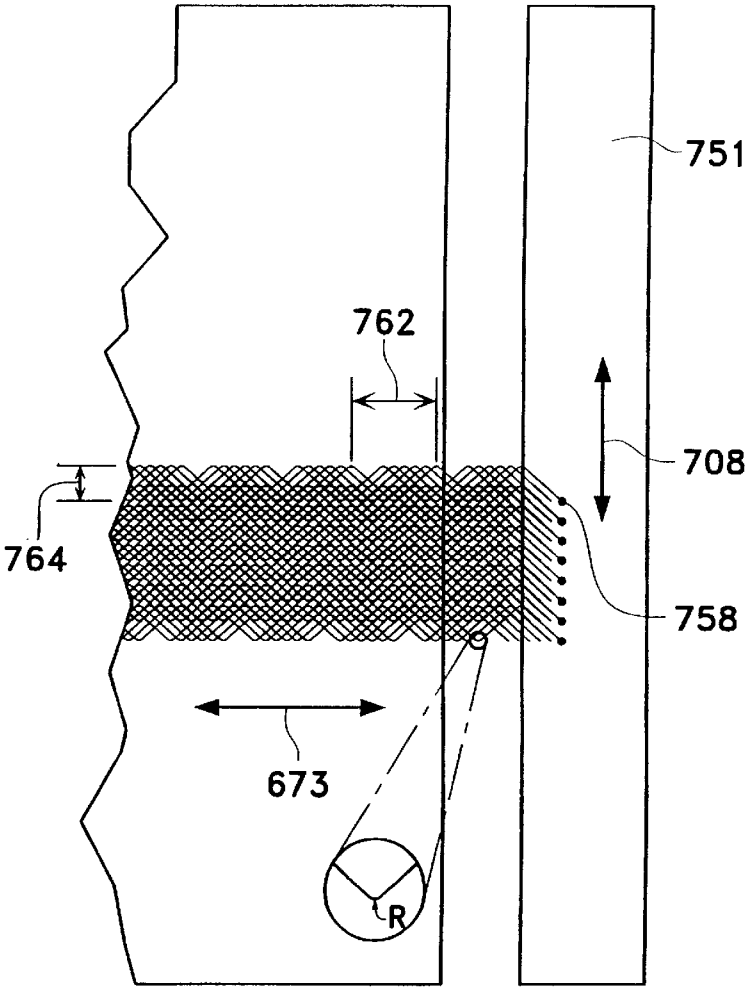
FIGS. 24A and 24B are diagrammatic representation of a sine wave conditioning patter and a triangular wave conditioning pattern respectively.
Figure 24A:
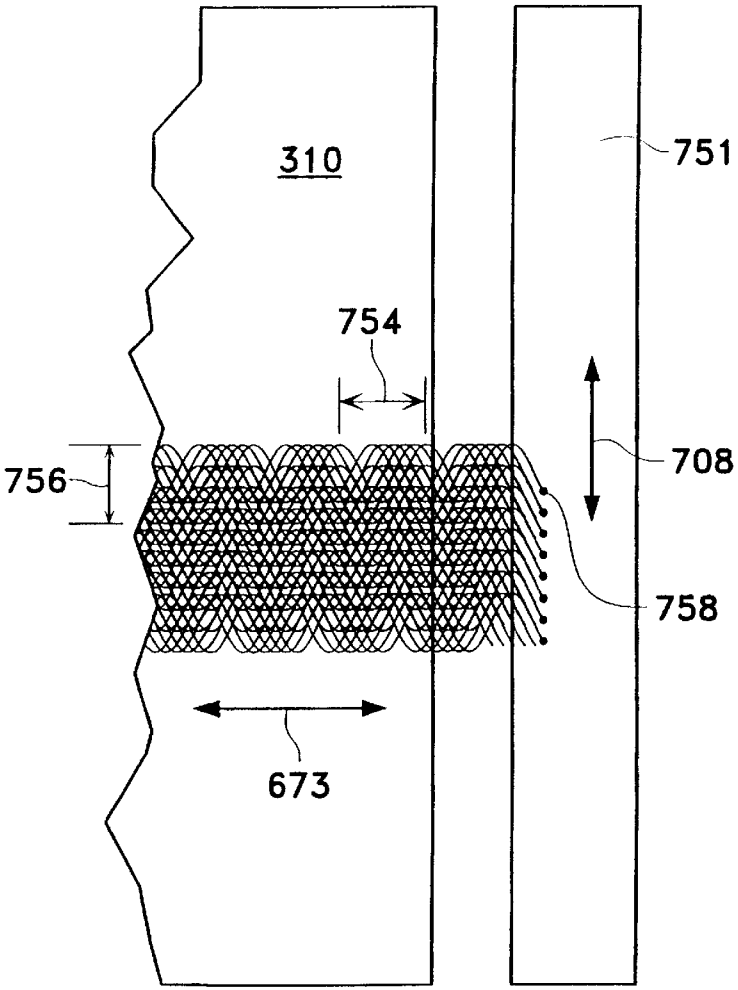

In addition, an infinite number of conditioning patterns may be produced with this conditioning system. FIGS. 24A and 24B show two examples of the types of patterns that may be produced. These Figures show a conditioning head portion 751 having a great number of points 758. Each point may represent the respective high spots of the surface geometry created by machining, etching, bonded abrasives, etc. as described above. Conditioning head portion 751 is programmed to move both directions indicated by arrows 708 and 763 as provided by the mechanism describe above with reference to FIGS. 22 and 23.

In the example of FIG. 24A, conditioning head portion 751 is programmed to be driven in a sine wave pattern. The various points along the width of the conditioning head portion 751 forming overlapping sine waves. This is the pattern that will be formed on polishing media 310. The sine wave produced may have any desired period 754 and amplitude 756 (peak to peak). A period of about 2 inches and an amplitude of about 1.3 inches has been found to be suitable for polishing in some circumstances.

In the example of FIG. 24B, conditioning head portion 751 is programmed to be driven in a triangular wave pattern, creating overlapping triangular waves of period 762 and amplitude 764 (peak to peak). As seen in FIG. 24B, this creates a more uniform pattern on the polishing media 310 and may result in improved polishing.

Although the triangular pattern is somewhat more uniform, it is may be harder on the mechanism to produce than the sine wave pattern. Obtaining such sharp triangular points requires instantaneous changes in conditioning head velocities. To alleviate this problem, the point of each triangle may have a small radius, R as shown. Radius, R must be chosen such that the acceleration required of the conditioning head is within acceptable limits of the servo drive mechanism employed. In a preferred embodiment having a period of about 2 inches and an amplitude of about 1.41 inches, the radius R may be approximately 0.125 inches.

Since the traversing conditioning system described above generally uses a rigid platen to support the polishing media during conditioning, it is very important for that the platen be flat. This is true also because the platen also supports the conditioned polishing media during polishing. For certain polishing applications it may be desirable to heat the platen support (to improve chemical reactiveness) or to cool the platen support (to remove the heat generated during polishing). Such temperature variations cause the platen support to expand or contract according to the change in temperature and in relation to the coefficient of thermal expansion of the platen support.

Referring to FIG. 4A, platen support is shown mounted to base 302. Base 302 may be thermally isolated from platen support 355 or otherwise constructed in a manner that allows for expansion and contraction as a result of temperature differentials. Because of the non-steady state temperatures involved with the operation of the polishing tape magazine during polishing, it is important not to overly constrain platen support 355 when mounting to base 302, yet at the same time provide mounting sufficient to endure the loads during polishing.

Figure 25:
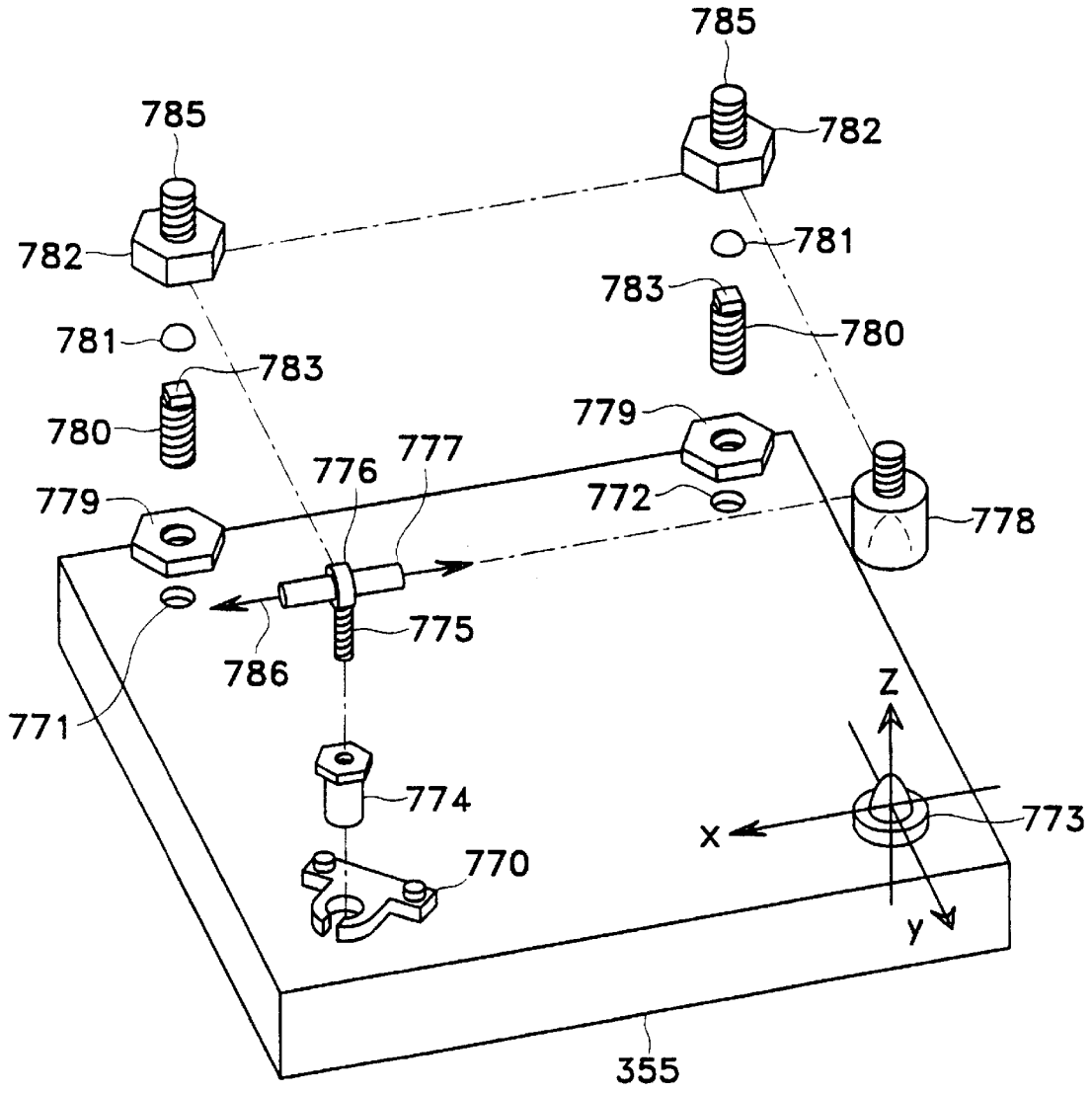
FIG. 25 is a perspective view from underneath the polishing media magazine showing the support platen mounting.

FIG. 25 illustrates a preferred mounting scheme for platen support 355. FIG. 25 is showing the bottom surface of platen support 355. The mounting scheme utilizes a four-point mount. A first mounting point is designed to secure the platen support in the three translational degrees of freedom shown as x, y and z. This is accomplished by way of a male cone-shaped feature 773 mounted to the support platen 355 which will couple with a female cone-shaped feature 778 (which is attached to base 302, not shown in FIG. 25 for clarity).

A second mounting point is designed to allow platen support 355 to freely expand in the x direction only. For this purpose, a clamp collar 770 is fixed to the platen support 355. Clamp collar 770 receives internally threaded cylinder 774 to the desired height (z elevation) then secures cylinder 774 in place. Internal threads 774 receive threaded slide 775. Threaded slide 775 has a self-orienting ball joint 776 which is allowed to slide over rod 777 which is fixedly attached to base 302. In operation, threaded slide 775 may be adjusted to the desired height by threading it in or out of cylinder 774.

The remaining two mounting points operate in the same manner. Platen support 355 has internal threaded mounting point 771. Threaded post 780 is threaded into 771 to obtain the desired height at the generally flat head region 783. Jam nut 779 is threaded over post 780 and tightened against platen support 355 to ensure that the elevation of post 780 does not change. Base 302 has threaded insert 782. Threaded insert 782 is adapted to receive aligning unit 781, which is shaped generally as a half-sphere having a flat section. Aligning unit 781 is allowed to rotate within threaded insert 782 to align the flat section to flat head region 783 of threaded post 780. The flat head region 783 may slide freely in either the x-direction or y-direction against flat section of threaded insert 782.

Figure 26:
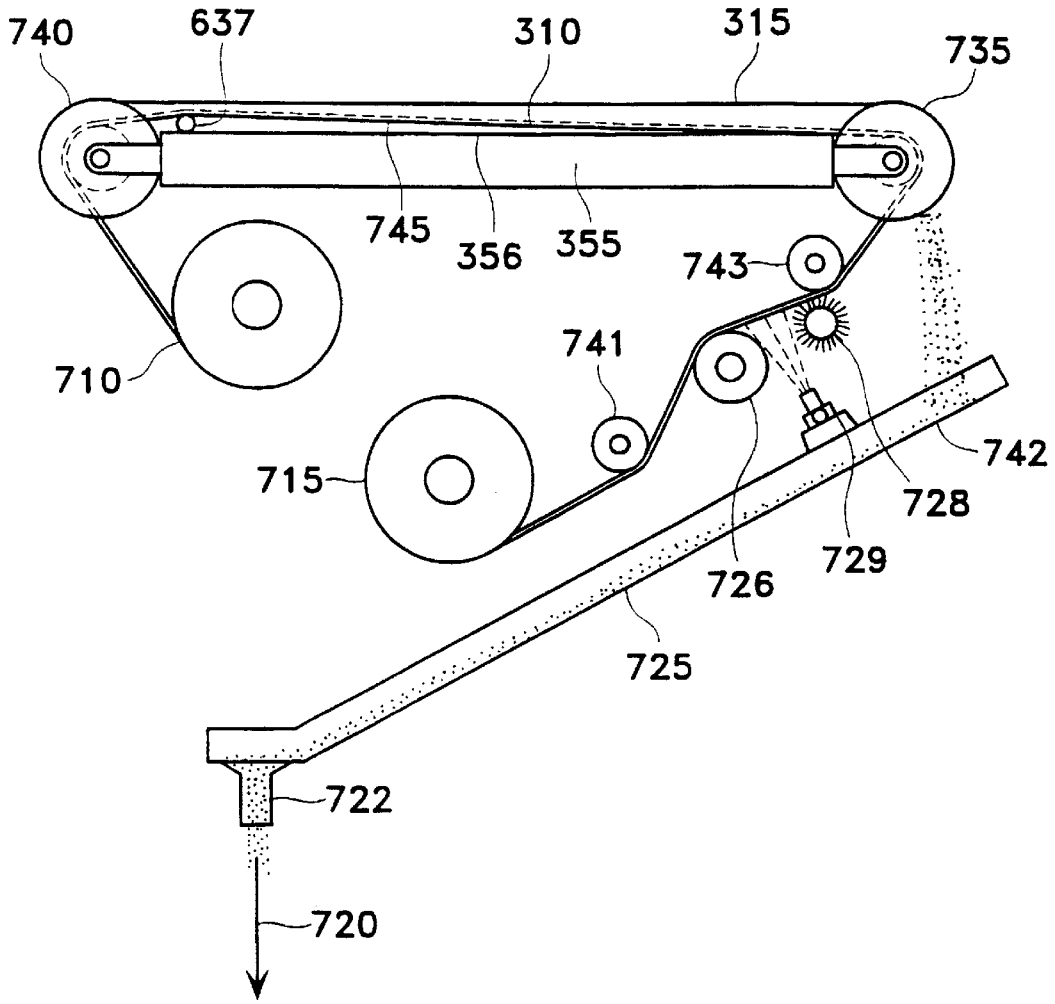
FIG. 26 is front view of an alternate construction of the polishing media magazine according to the principles of the present invention.

To reduce the amount of room required for the polishing media magazine, the construction illustrated in FIG. 26 is preferred. FIG. 26 illustrates a polishing media path through the inventive polishing media magazine that uses considerably less space. Any of the principles discussed above related to uniform conditioning and the containment of polishing fluids may be applied to this embodiment.

In this configuration supply roll 710 and take-up roll 715 are placed underneath the platen support 355. This embodiment again employs raised edge sections 315 of the polishing media created in any of the manners set forth above. Preferably raised features extend the length of the platen support 355. Transverse rod 637, as described above, raises the polishing media bottom surface 745 above ground horizontal so that the polishing fluid exits only at turnbar 735 and not over turnbar 740.

An lengthened waste bin 725 may be required to catch the polishing fluid 742 that may drip from the polishing media as shown. If the polishing media magazine is equipped with a roller and/or brush type conditioning element, waste bin 725 may also serve as a splash guard. Waste bin 725 may terminate at a drain 722 which allows for controlled disposal of polishing fluid 742.

The conditioning element may involve roller 726, rotating brush 728, and a number of nozzles 729 as described at length above. Such conditioning elements may require placement of rolling turnbars 743 and 741 to ensure the desired contact area and resultant force as described above. As an alternative, a traversing type conditioning system which operates in the processing area may be employed. In that case, the polishing media would span from turnbar 735 directly to take-up roll 715.

Figure 27:
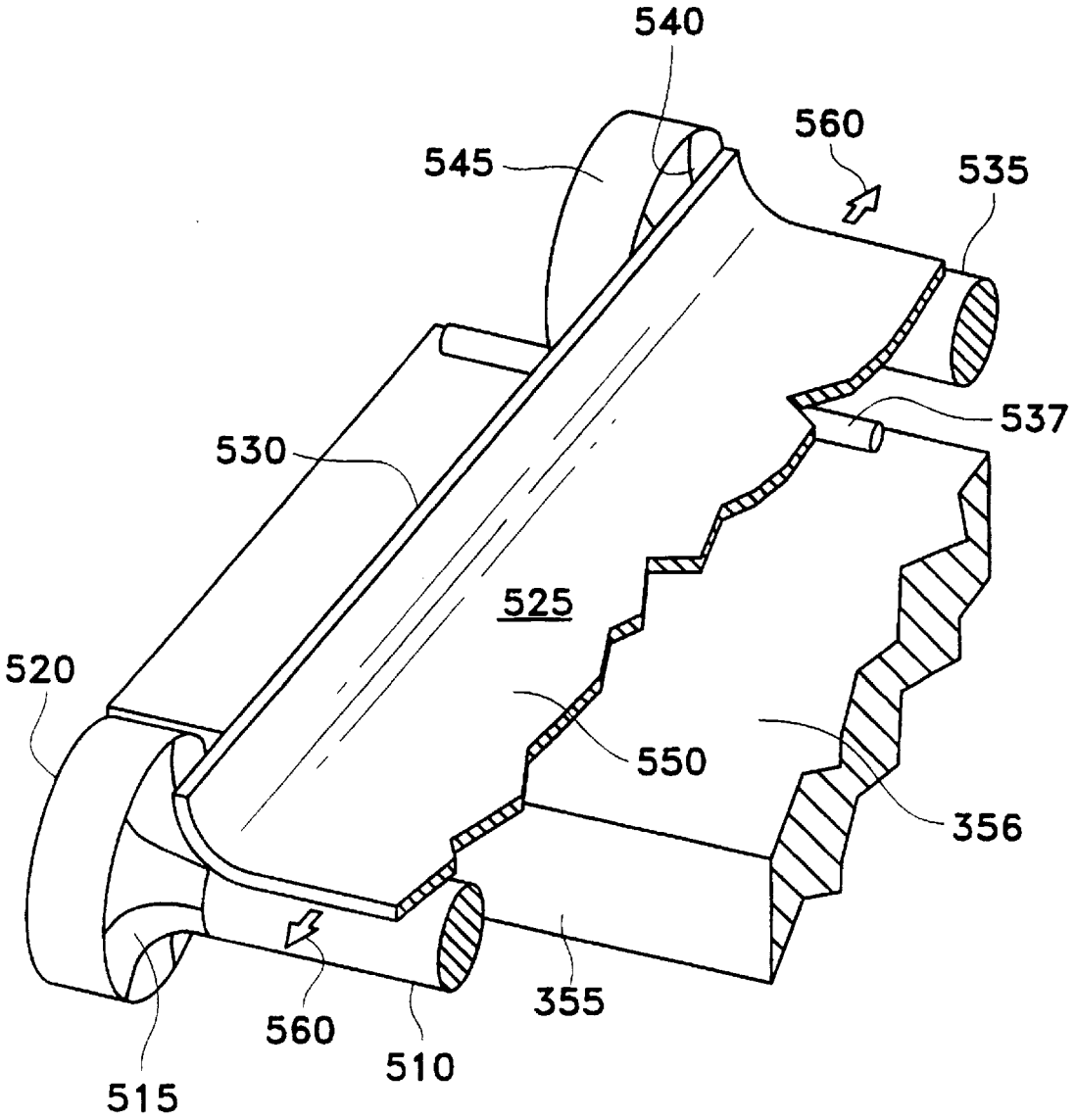
FIG. 27 is a partial perspective view of another embodiment of the polishing fluid containment apparatus corresponding to the polishing media magazine construction of FIG. 26.

FIG. 27 illustrates another view of the preferred construction of FIG. 26. It is similar to the construction depicted in FIG. 10 except that because both supply roll 710 and take up roll 715 are located below platen 355, two increasing diameter rolling turnbars are used to form raised edge 530 in polishing media 550 (shown in partial cross-section). As with the other constructions discussed, a web tension applied from the supply roll 300 or take-up roll 340 (FIG. 4) in the direction of arrows 560 forces the polishing media 550 into conformance with the smaller diameter shaft portions 535 and 510 and contoured transition portions 515 and 540 create the raised edge 530. Smaller diameter portions 510 and 535 are again constructed to be approximately tangent with upper surface 356. This tends to ensure good contact between the polishing media 525 and upper surface 356 of support platen 355.

Another important aspect of the polishing media magazine is the ability to improve polishing results through the use of the tension supplied to the polishing media. As discussed above, the tension in the polishing media may aid in supplying the raised edge portions for polishing fluid containment and effectuates the desired contact force against certain conditioning elements. Another important use of the applied tension to the polishing media involves the capability to modify the mechanical behavior properties of the polishing media itself according to the applied tensile loading.

Figure 28:
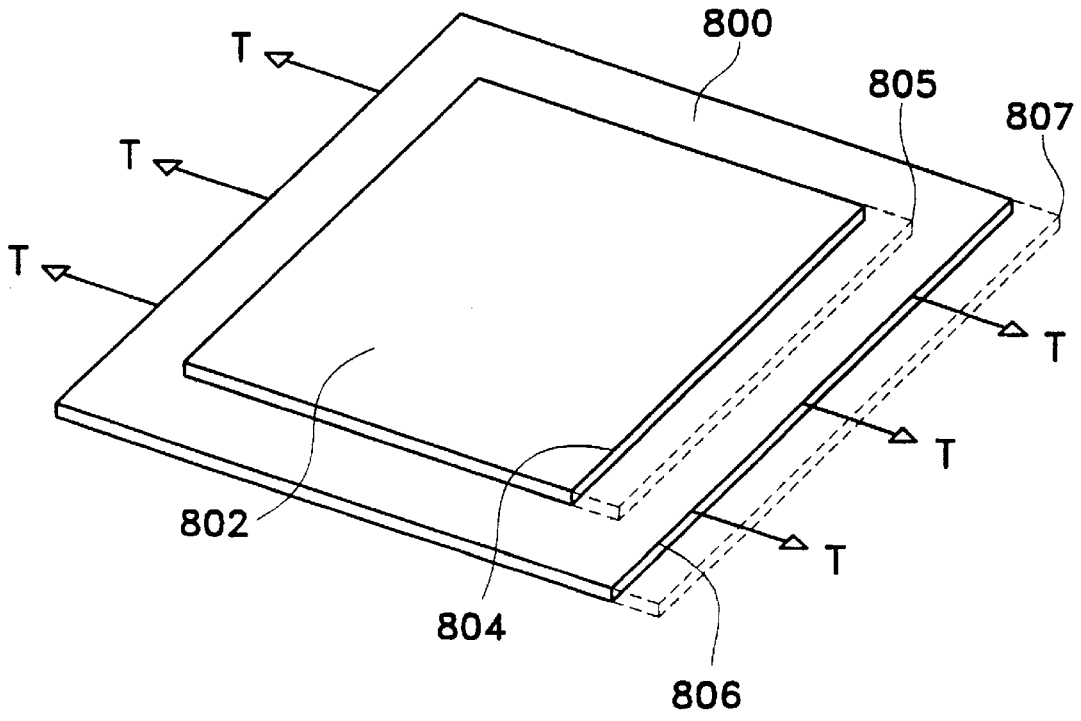
FIG. 28 is a diagrammatic perspective view showing a polishing media element subjected to tension.

FIG. 28 illustrates a section of polishing media subjected to a tensile load, T. The polishing media comprises a carrier film 800 laminated to the polishing material 802. The application of tension, T to the carrier film results in deformation from the original size 806 to the deformed size 807. Since polishing material 802 is laminated to carrier film 800, is likewise undergoes a corresponding change from original size 804 to deformed size 805. Although the polishing media is illustrated as having both a carrier film and a polishing material, the concepts hereinafter described work equally well with a single layer polishing media or any multiple layer polishing media sufficiently laminated such that application of tensile loading to one layer is adequately transferred to other layers.

The application of tension to the polishing media may have several effects on the mechanical properties of the polishing media. Application of steady state axial (or biaxial) tensile loading of the polishing material may alter the molecular state (amorphous vs. crystalline) of the polishing material thereby effectively modifying the mechanical properties of the pad. This allows the polishing media magazine to set, or modify the mechanical properties of the polishing media 310, at any time prior to, or during the course of the polishing process.

One important polishing material property which can be modified by the application of tensile loading is the tangent loss factor (Tan δ), where Tan δ is a measure of the material's dynamic dampening characteristics. The tangent loss factor is calculated as the ratio of the loss modulus (E") to the storage modulus (E') of the material.

The importance of this ratio, Tan δ, and its relation to the dampening properties of the polishing media is discussed below with reference to FIGS. 29 and 30. During polishing, the polishing media is subjected to a complex set of dynamic loads. For instance, the polishing media may be subjected to the compressive forces imparted by the downward force applied to the workpiece by the polishing head or carrier, the shear loading due to the friction as a result of polishing actions, hydrodynamic loadings resulting from any polishing fluids, and substrate carrier moment loading, and other less significant loading.

In response to these dynamic loading conditions, deformation waves are induced within the polishing media 824. The deformation waves tend to cause areas of over and under polish, thus adversely effecting the polished product. The deformation waves may be formed either locally near any surface protrusion on the workpiece or globally near the edge of the workpiece itself.

Figure 29:
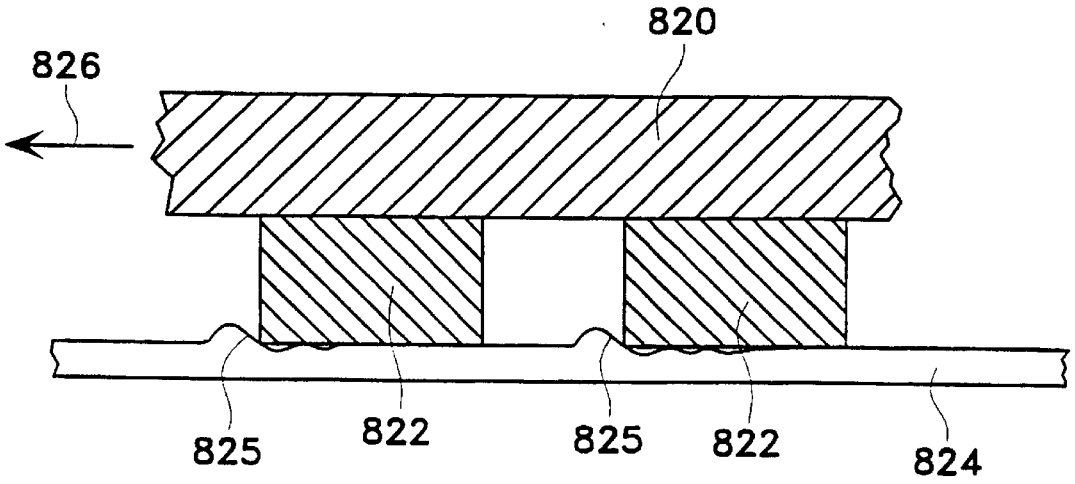
FIG. 29 is a diagrammatic partial cross-section showing the formation of spatial waves in the polishing media.

FIG. 29 shows a greatly magnified view of wafer 820 being polished by polishing media 824. Wafer 820 has certain semiconductor devices 822 fabricated on its surface. Localized deformation waves 825, caused by the dynamic loading of the polish process, may form at the leading edge, or trailing edge of each device 822 as wafer 820 is moved in the direction indicated by arrow 826. The frequency of the deformation waves are dependent upon the geometry of the devices and the overall topography of the substrate (i.e. the spatial distance between devices), and the relative polishing velocity between wafer 820 and polishing media 824. Such local waves are typically of small magnitude and relatively high frequency (generally greater than about 60 Hz.).

Figure 30:
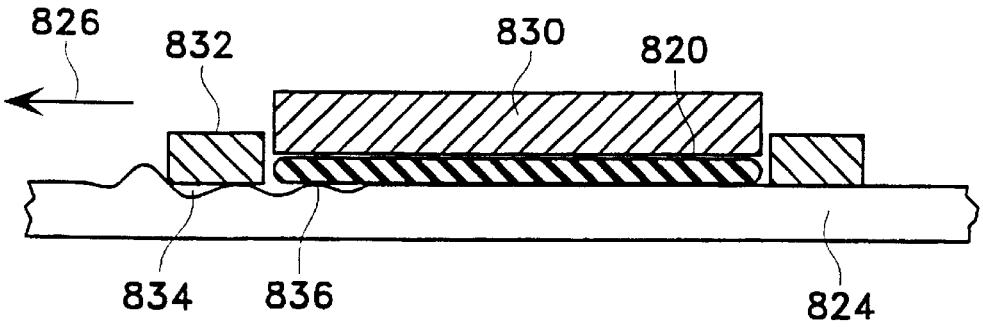
FIG. 30 is a diagrammatic partial cross-section showing the formation of global waves in the polishing media.

FIG. 30 shows an example of global deformation waves. Wafer 820 is supported by carrier 830 and containment ring 832. As wafer 820 is moved across the surface of polishing media 824 in the direction indicated by arrow 826, global deformation waves form. Global deformation waves can be generated wherever sudden step heights in geometry occur, such as the leading and trailing edges of containment ring 283, or at the leading trailing edges of wafer 820. In the case shown, containment ring 832 contacts polishing media 824 and deformation waves 834 will form at the leading edge of containment ring 832. The existence of the global deformation waves may cause an area of under-polish at the leading edge of the wafer where the wave is low, and an area of over-polish at the wave peaks, i.e. peak 836. These waves are dependent primarily on the relative velocity between the wafer 820 and the polishing media 824 and are generally of larger magnitude and lower frequency.

Once generated during polishing, the degree to which these induced waves propagate or dampen within the polishing media is dependent upon the mechanical properties of the polishing material. The ability to modify the dampening characteristics of the polishing material, specifically the tangent loss factor (Tan δ), allows a controllable means of adjusting out the wave deformations generated in the polishing process. With selective modification of the dampening characteristics of the pad, specific frequencies can be attenuated resulting in superior planarization of the polished product.

The application of the applied axial or bi-axial stress in the polishing media does not have to be limited to steady state conditions. It may be desirable to vary or modify the tensile loading applied to the polishing media during polishing. This allows for proportioning the polishing process for optimization of both the local and global planarization. Essentially, varying the mechanical properties of the polishing media becomes a relatively easy in-process adjustment by controlling the tension of the polishing media during processing by utilizing the supply roll, take-up roll, and load cell feedback as described with reference to the polishing media magazine above.

Of course, this important concept of altering the physical or mechanical properties of a polishing media to improve polishing is not limited to a tensioned web type polishing media magazine. Any type of polishing machine adapted to apply an appropriate loading may be used.

Figure 31:
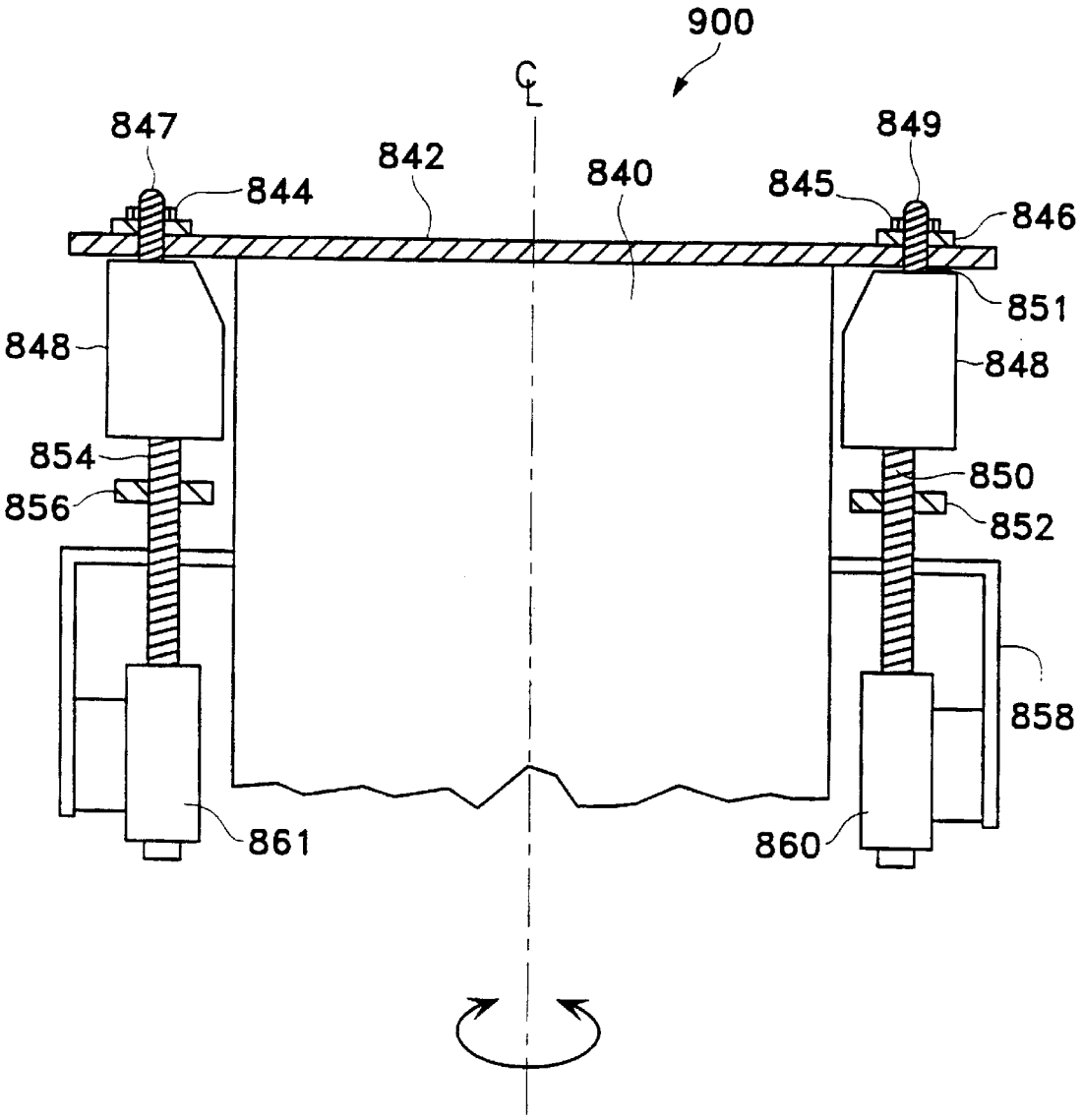
FIG. 31 is a diagrammatic view in partial cross-section showing an illustrative apparatus for tensioning a circular polishing pad over a circular platen in an unactuated position.
Figure 32:
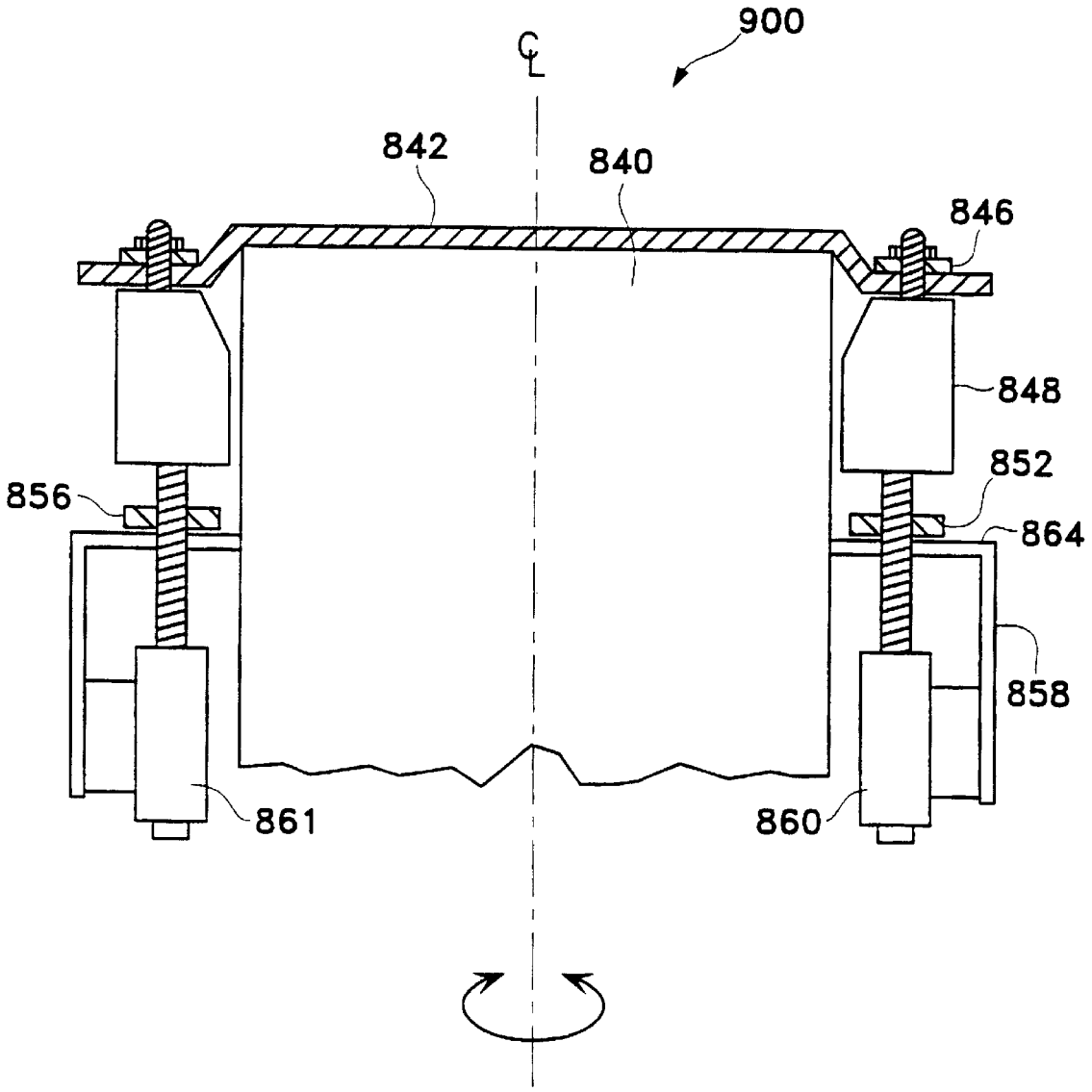
FIG. 32 is a diagrammatic view in partial cross-section of the apparatus of FIG. 31 in an actuated position.

An example of a rotating platen type polishing machine adapted to control the mechanical properties of the polishing media by the application of strain loading is shown in FIGS. 31 and 32. FIG. 31 shows polishing machine 900 having cylindrical rotating platen 840. Concentric ring member 848 is configured to slide up and down over a portion of rotating platen 840. Concentric ring member 848 has an upper surface 851 with a number of threaded studs (847 and 849) extending therefrom for polishing media installation.

Polishing media 842 is supplied in the form of a circular disk with clearance holes patterned to correspond to threaded studs 847 and 849. Polishing media 842 is installed to the polishing machine by locating in atop the rotating platen 840 and installing it over threaded studs 847 and 849. Rigid clamp ring 846 is then placed over threaded studs 847 and 849 and secured by locking nuts 845. There may be a number of such threaded studs and locking nuts around the diameter of concentric ring member 848 and clamp ring 846.

Rotating platen 840 is constructed with a mounting flange 858 to which a plurality of linear actuators are mounted. Two such actuators (860 and 861) are shown. Rods 850 and 854 are coupled at a first end to linear actuators 860 and 861 respectfully. The second end of rods 850 and 854 are fixed to concentric ring member 848.

Linear actuators 860 and 861 forcibly act to retract rods 850 and 854, thus forcing concentric ring member 848 to a lowered position as shown in FIG. 32. As concentric ring member 848 is lowered with respect to the top surface of rotating platen 840, polishing media 842 is subjected to radial loading. This type of loading has the desired effect of changing the mechanical properties of the polishing media as described above.

The amount of downward travel of concentric ring member 848 may be controlled by way of an adjustable mechanical hard-stop, such as nuts 864 and 856 which stop further travel as they contact surface 864 of mounting flange 858. Alternatively, linear actuators 860 and 861 may be controlled to deliver any desired force, and thus any desired loading to the polishing material. This type of control may allow for simple in-process adjustment of the mechanical properties of the polishing media.

The features of the polishing media magazine described above that deal with the specifics of a given construction is not for the purposes of limitation, but instead for the purposes of illustration and example. For example, it will be appreciated by those skilled in the art that certain aspects of this invention may be readily practiced on systems that do not have roll fed polishing media but alternatively fix the media to a support platen or employ a continuous belt. It is intended that this application include these and other such modifications that would be apparent to one of ordinary skill in the art upon reading this description of the present invention. Accordingly, the scope of the present invention may be ascertained only by reference to the appended claims.

What is claimed is:

1. A method of conditioning a polishing media, comprising:

(a) applying tension to the polishing media such that a tensioned web is created, said web having a width and an initial position;

(b) indexing a portion of said tensioned web in a forward direction to pass a conditioning element at a predetermined velocity, said conditioning element spanning substantially the entire width of said tensioned web; and (c) indexing said tensioned web in a reverse direction to a final position.

2. The method of claim 1, wherein said initial position and said final position are substantially the same.

3. The method of claim 1, wherein said final position is an incremental distance forward of said initial position.

4. A method of conditioning a polishing media, comprising:

(a) applying tension to the polishing media such that a tensioned web is created, said web having a width and an initial position;

(b) indexing a portion of said tensioned web in a forward direction to pass a conditioning element at a predetermined velocity, said conditioning element spanning substantially the entire width of said tensioned web; and (c) controlling the contact pressure between said tensioned web and said conditioning element by manipulating the tension applied to the web.

5. A method of conditioning a polishing media, comprising:

(a) supporting said polishing media with a support platen, said polishing media having a length and a width;

(b) forcing a conditioning element to contact said polishing media across substantially the entirety of said width; and (c) directing said conditioning element to traverse the length of said polishing media according to a predetermined path, wherein said predetermined path is a sine wave.

6. A method of conditioning a polishing media, comprising:

(a) supporting said polishing media with a support platen, said polishing media having a length and a width;

(b) forcing a conditioning element to contact said polishing media across substantially the entirety of said width; and (c) directing said conditioning element to traverse the length of said polishing media according to a predetermined path, wherein said predetermined path is a triangular wave.

7. A polishing media magazine for providing a conditioned polishing surface comprising, a polishing media having a width and a conditioning element extending across the full width of said polishing media, wherein at least a portion of said polishing media is tensioned, wherein said tensioned portion is positionally indexable in a first direction, such that a desired area of said tensioned portion is indexable to said conditioning element for conditioning.

8. The polishing media magazine of claim 7, wherein said conditioning element is positioned to contact said tensioned portion at a position outside of said supported area.

9. The polishing media magazine of claim 8 wherein said position outside of said supported area is substantially vertical.

10. The polishing media magazine of claim 8 wherein said conditioning element is a non-rotating bar.

11. The polishing media magazine of claim 10 wherein said bar is stationary.

12. The polishing media magazine of claim 10, wherein said bar is configured to move relative to said polishing media in at least one axis.

13. The polishing media magazine of claim 8, wherein said conditioning element is a roller having a generally cylindrical outer surface.

14. The polishing media magazine of claim 13, wherein said roller is adapted to rotate relative to said tensioned portion.

15. The polishing media magazine of claim 14, wherein said roller rotates at a substantially constant rotational velocity.

16. The polishing media magazine of claim 13, wherein said outer surface has a surface geometry for conditioning said polishing media.

17. The polishing media magazine of claim 16, wherein said outer surface is diamond coated.

18. The polishing media magazine of claim 16, wherein said outer surface is ceramic coated.

19. The polishing media magazine of claim 16, wherein said surface geometry is hardened steel.

20. The polishing media magazine of claim 8, wherein said conditioning element is a rotating brush.

21. The polishing media magazine of claim 20 wherein said rotating brush comprises a plurality of outwardly extending bristles.

22. The polishing media magazine of claim 21, wherein said bristles are nylon.

23. The polishing media magazine of claim 22, wherein said bristles are steel.

24. The polishing media magazine of claim 8, wherein said conditioning element comprises a conditioning media web and a support roller, said conditioning media web held in tension around at least a portion of the periphery of said roller.

25. The polishing media magazine of claim 7, wherein said conditioning element is a rotating brush positioned to contact said tensioned portion at a position outside of said supported area, and further comprising a plurality of spray nozzles positioned in proximity to said rotating brush, said spray nozzles adapted to provide a generally uniform fluid spray across said full width of said surface.

26. The polishing media magazine of claim 25, further comprising a splash guard near each end of said rotating brush for the containment of said fluid.

27. The polishing media magazine of claim 7, wherein the conditioning element is a roller having a generally cylindrical outer surface and said conditioning element is positioned to contact said tensioned portion at a position outside of said supported area, such that said tensioned portion wraps around a predetermined number of degrees of said cylindrical outer surface.

28. The polishing media magazine of claim 27, wherein said predetermined number of degrees is greater that 5 degrees.

29. The polishing media magazine of claim 7, wherein the conditioning element is a roller having a generally cylindrical outer surface and is positioned to contact said tensioned portion at a position outside of said supported area, wherein said outer surface is formed with a plurality of replaceable shell elements.

30. A polishing media magazine for providing a conditioned polishing surface comprising:

a polishing media having a width;

a conditioning element extending across the full width of the polishing media, wherein at least a portion of the polishing media is tensioned; and a support platen having a generally flat upper surface, the upper surface positioned to support an area of the tensioned portion, wherein the supported area is used for polishing and the conditioning element is adapted for movement relative to the supported area movable in both a first direction and in a second direction substantially perpendicular to the first direction such that the conditioning element is capable of traversing a predetermined pattern over the supported area.

31. A polishing media magazine for providing a conditioned polishing surface, comprising:

a polishing media having a width and a conditioning element extending across the full width of said polishing media, wherein at least a portion of said polishing media is tensioned;

a support platen having a generally flat upper surface, said upper surface positioned to support an area of said tensioned portion, wherein said supported area is used for polishing, and said conditioning element is adapted for movement relative to said supported area, wherein said conditioning element is movable in both a first direction and in a second direction substantially perpendicular to said first direction such that said conditioning element is capable of traversing a predetermined pattern over said supported area; and a drive mechanism for moving said conditioning element, said drive mechanism comprising:

(a) a first support base positioned on a first side of said process area and a second support base positioned on a second side of said process area;

(b) a transverse support extending from said first support base to said second support base, said transverse support being selectively movable along said first direction; and (c) a conditioning element attached to a mounting structure, said mounting structure being attached to said transverse support such that said mounting structure is selectively movable along said second direction.

32. The polishing media magazine of claim 31, wherein at least one of said first and second support bases further comprise a motor driven lead screw, and said transverse support further comprising a threaded bushing, said lead screw being threaded into said bushing such that rotation of said lead screw results in motion of said transverse support along said first direction.

33. The polishing media magazine of claim 31, wherein said transverse support further comprises a transverse lead screw and said mounting structure further comprises a threaded bushing such that rotation of said transverse lead screw results in motion of said mounting structure along a second direction.

34. A polishing media magazine for providing a conditioned polishing surface, comprising:

a polishing media having a width and a conditioning element extending across the full width of said polishing media, wherein at least a portion of said polishing media is tensioned, and wherein said conditioning element is mounted to a mounting structure, said mounting structure being adapted to self-align to a supported area when said conditioning element is forced into contact with said supported area; and a support platen having a generally flat upper surface, said upper surface positioned to support an area of said tensioned portion, wherein said supported area is used for polishing, and said conditioning element is adapted for movement relative to said supported area, wherein said conditioning element is movable in both a first direction and in a second direction substantially perpendicular to said first direction such that said conditioning element is capable of traversing a predetermined pattern over said supported area.

35. The polishing media magazine of claim 34, wherein said conditioning element is pivotably mounted to said mounting structure.

36. A polishing media magazine for providing a conditioned polishing surface, comprising:

a polishing media having a width and a conditioning element extending across the full width of said polishing media, wherein at least a portion of said polishing media is tensioned; and a support platen having a generally flat upper surface, said upper surface positioned to support an area of said tensioned portion, wherein said supported area is used for polishing, wherein said support platen comprising a substantially planar portion and at least one raised portion adapted to direct an edge of said polishing media upwards for containing polishing fluid.

37. The polishing media magazine according to claim 36, wherein said support platen comprises at least two raised portions arranged in an opposing relationship.

38. The polishing media magazine according to claim 37, further comprising a raised element transverse to said raised portions.

39. A polishing media adapted to contain polishing fluid, said polishing media comprising a substantially planar center section and two raised edge sections, wherein said polishing media is substantially impermeable to said polishing fluid and said polishing media is tensioned between a supply roll and a take-up roll.

40. A polishing media adapted to contain polishing fluid, said polishing media comprising a substantially planar center section and two raised edge sections, wherein said polishing media is substantially impermeable to said polishing fluid and said polishing media is a continuous belt.

41. A polishing platen apparatus adapted to support a polishing media, said platen comprising:

a substantially planar portion and a raised portion adapted to direct an edge of said polishing media upwards;

at least two raised portions arranged in an opposing relationship; and a raised element transverse to said raised portions, wherein said raised portions comprise one or more rollers.

42. The polishing platen apparatus according to claim 41, wherein said rollers have a contoured face.

43. The polishing platen apparatus according to claim 41, wherein said rollers having an axis of rotation substantially perpendicular to said planar portion.

44. A conditioning apparatus for conditioning a polishing media, comprising:

a conditioning element extending across a full width of the polishing media; and a vacuum platen associated with said conditioning element, said vacuum platen positioned in proximity to the polishing media such that the polishing media is biased against said conditioning element when a vacuum is applied to said vacuum platen.

45. A conditioning apparatus for conditioning a polishing media, comprising:

a conditioning element extending across a full width of the polishing media; and first and second rollers positioned relative to said conditioning element such that the polishing media is forced to contact said conditioning element, wherein said first and second rollers are independently driven with respect to the polishing media.

* * * * *

UNITED STATES PATENT AND TRADEMARK OFFICE

CERTIFICATE OF CORRECTION

PATENT NO. : 6,312,319 B1
DATED : November 6, 2001
INVENTOR(S) : Donohue et al.

It is certified that error appears in the above-identified patent and that said Letters Patent is hereby corrected as shown below:

Column 1,
Line 33, please replace “Modem” with -- Modern --.

Column 23,
Line 1, please delete “for”.

Column 24,
Line 4, please replace “An” with -- A --.

Signed and Sealed this

Twenty-seventh Day of August, 2002

*Attest:*

*Attesting Officer*

JAMES E. ROGAN
*Director of the United States Patent and Trademark Office*